US009752259B2

(12) United States Patent
Tao et al.

(10) Patent No.: US 9,752,259 B2
(45) Date of Patent: Sep. 5, 2017

(54) STRETCHABLE ELECTRICAL INTERCONNECT AND METHOD OF MAKING SAME

(75) Inventors: Xiaoming Tao, Kowloon (HK); Qiao Li, Kowloon (HK); Bo Zhu, Kowloon (HK)

(73) Assignee: THE HONG KONG RESEARCH INTITUTE OF TEXTILES AND APPAREL LIMITED, Kowloon (HK)

( * ) Notice: Subject to any disclaimer, the term of this patent is extended or adjusted under 35 U.S.C. 154(b) by 1042 days.

(21) Appl. No.: 13/442,388

(22) Filed: Apr. 9, 2012

(65) Prior Publication Data

US 2013/0263351 A1 Oct. 10, 2013

(51) Int. Cl.

| | |
|---|---|
| ***D02G 3/00*** | (2006.01) |
| ***D02G 3/44*** | (2006.01) |
| ***D04B 1/18*** | (2006.01) |

(52) U.S. Cl.

CPC ..... *D02G 3/441* (2013.01); *D04B 1/18* (2013.01); *D10B 2403/02431* (2013.01); *Y10T 29/49169* (2015.01); *Y10T 29/49204* (2015.01)

(58) Field of Classification Search

CPC ..... A41D 1/00; A41D 13/00; A41D 13/05; A41D 13/12; A61N 1/04; B32B 15/02; B32B 15/14; G01B 11/16; G02F 1/15; G03G 15/08; H01R 13/22; H01R 13/24; H01R 13/648; D02G 3/00; D02G 3/441; D03D 3/02; D04B 1/18

USPC ..... 174/74 R, 126.1, 250, 251, 254; 29/826, 29/855; 200/275; 361/212, 220; 156/184; 250/227.14; 428/221, 611; 600/388, 529; 139/383 R, 387 R; 219/545; 429/120; 439/67, 259, 775; 442/181, 182, 301

See application file for complete search history.

(56) References Cited

U.S. PATENT DOCUMENTS

| | | | | |
|---|---|---|---|---|
| 4,358,699 | A * | 11/1982 | Wilsdorf | H01R 39/24 310/251 |
| 4,398,277 | A * | 8/1983 | Christiansen | A61N 1/14 361/212 |
| 4,475,141 | A * | 10/1984 | Antonevich | 361/220 |
| 4,668,545 | A * | 5/1987 | Lowe | B29C 61/0658 139/387 R |
| 4,708,149 | A * | 11/1987 | Axelgaard | A61N 1/0452 29/877 |
| 4,722,354 | A * | 2/1988 | Axelgaard | A61N 1/0452 607/152 |
| 4,819,328 | A * | 4/1989 | Axelgaard | A61N 1/0452 156/289 |
| 4,867,166 | A * | 9/1989 | Axelgaard | A61N 1/0452 600/384 |
| 5,118,569 | A * | 6/1992 | Kuroda et al. | 428/367 |

(Continued)

FOREIGN PATENT DOCUMENTS

CN 1924131 A 3/2007

OTHER PUBLICATIONS

Li et al., "A stretchable knitted interconnect for three-dimensional curvilinear surfaces", Textile Research Journal, Apr. 8, 2011, pp. 1171-1182.

*Primary Examiner* — Xiaoliang Chen

(74) *Attorney, Agent, or Firm* — Buchanan Ingersoll & Rooney PC

(57) ABSTRACT

An electrical interconnect including at least one electrically-conductive fiber configured to form a stretchable interlaced configuration.

7 Claims, 23 Drawing Sheets

(56) References Cited

U.S. PATENT DOCUMENTS 5,196,985 A * 3/1993 Ford ..... H05F 3/02 361/212
5,385,774 A * 1/1995 Cramer ..... B32B 5/26 296/100.01
5,440,444 A * 8/1995 Adams ..... A41D 13/008 361/212
5,456,782 A * 10/1995 Fujita ..... G03G 15/0818 156/169
5,677,674 A * 10/1997 Wolf ..... G08B 13/126 340/541
6,315,009 B1 * 11/2001 Jayaraman ..... A41D 13/1281 139/387 R
6,381,482 B1 * 4/2002 Jayaraman ..... A61B 5/6805 600/388
6,474,367 B1 * 11/2002 Jayaraman ..... A41D 13/1236 139/383 R
6,687,523 B1 * 2/2004 Jayaramen ..... A41D 13/1281 600/388
6,970,731 B1 * 11/2005 Jayaraman ..... A61B 5/0008 600/388
7,337,012 B2 2/2008 Maghribi et al.
7,342,311 B2 3/2008 Krulevitch et al.
7,491,892 B2 2/2009 Wagner et al.
7,521,292 B2 4/2009 Rogers et al.
7,557,367 B2 7/2009 Rogers et al.
7,871,661 B2 1/2011 Maghribi et al.
8,097,926 B2 1/2012 De Graff et al.
8,107,153 B2 * 1/2012 Sotzing ..... G02F 1/1533 359/265
2001/0022298 A1 * 9/2001 Rock ..... A41D 13/0051 219/545
2001/0024735 A1 * 9/2001 Kuhlmann-Wilsdorf H01R 39/22 428/611
2002/0086204 A1 * 7/2002 Rock ..... A41D 13/0051 429/120
2002/0088931 A1 * 7/2002 Danisch ..... G01B 11/18 250/227.14
2002/0094701 A1 7/2002 Biegelsen et al.
2003/0134525 A1 * 7/2003 Sweetland ..... H01R 13/2407 439/67
2003/0214399 A1 * 11/2003 Naruse ..... G01K 1/026 340/531
2003/0225360 A1 * 12/2003 Eppstein ..... A61M 37/0015 604/19
2004/0009693 A1 * 1/2004 Sweetland ..... H01R 13/2492 439/259
2004/0048500 A1 * 3/2004 Sweetland ..... H01R 13/2407 439/67
2004/0214454 A1 * 10/2004 Sweetland ..... H01R 13/052 439/67
2005/0014421 A1 * 1/2005 Sweetland ..... H01R 4/58 439/775
2005/0045461 A1 * 3/2005 Sweetland ..... H01H 1/06 200/275
2005/0048859 A1 * 3/2005 Canham ..... A61B 17/06166 442/189
2005/0054941 A1 * 3/2005 Ting ..... A61B 5/0408 600/529
2005/0062486 A1 * 3/2005 Qi et al. ..... 324/693
2005/0159028 A1 * 7/2005 Sweetland ..... H01R 4/58 439/67
2006/0038182 A1 2/2006 Rogers et al.
2006/0130923 A1 * 6/2006 Lepola ..... F16L 55/1654 138/98
2006/0175187 A1 * 8/2006 Marmaropoulos .... D02G 3/441 200/514
2006/0258247 A1 * 11/2006 Tao ..... D03D 1/0088 442/301
2006/0261985 A1 * 11/2006 Sandbach ..... D02G 3/441 341/34
2006/0281382 A1 * 12/2006 Karayianni ..... D03D 1/0088 442/181
2007/0059524 A1 3/2007 Voigt
2007/0089800 A1 * 4/2007 Sharma ..... D02G 3/441 139/388
2007/0289859 A1 * 12/2007 Sandbach ..... D02G 3/441 200/506
2008/0015454 A1 * 1/2008 Gal ..... A41D 13/1281 600/509
2008/0157235 A1 7/2008 Rogers et al.
2009/0018428 A1 * 1/2009 Dias ..... A41D 13/1281 600/388
2009/0128168 A1 * 5/2009 Qi et al. ..... 324/693
2009/0159149 A1 * 6/2009 Karayianni et al. ..... 139/425 R
2009/0183296 A1 * 7/2009 Hardee et al. ..... 2/161.8
2009/0216305 A1 * 8/2009 Bonner ..... 607/108
2009/0314411 A1 * 12/2009 Kawaguchi et al. ..... 156/60
2009/0314539 A1 * 12/2009 Kawaguchi et al. ..... 174/350
2009/0317639 A1 12/2009 Axisa et al.
2010/0002402 A1 1/2010 Rogers et al.
2010/0087782 A1 4/2010 Ghaffari et al.
2010/0116526 A1 5/2010 Arora et al.
2010/0143848 A1 6/2010 Jain et al.
2010/0163283 A1 * 7/2010 Hamedi ..... D03D 1/0088 174/254
2010/0170886 A1 * 7/2010 Qi et al. ..... 219/482
2010/0199901 A1 8/2010 Kang et al.
2010/0238636 A1 9/2010 Mascaro et al.
2010/0245971 A1 * 9/2010 Sotzing ..... G02F 1/1533 359/265
2010/0258334 A1 * 10/2010 Akaike ..... B60N 2/5685 174/126.1
2010/0271191 A1 10/2010 De Graff et al.
2010/0330338 A1 12/2010 Boyce et al.
2011/0074380 A1 * 3/2011 Jeon ..... D03D 13/00 323/318
2011/0126335 A1 * 6/2011 Schultz ..... B32B 5/26 2/2.5
2011/0254171 A1 10/2011 Guo et al.
2011/0290296 A1 * 12/2011 Daniel ..... H01L 31/042 136/244
2013/0102217 A1 * 4/2013 Jeon ..... D03D 15/0027 442/182
2013/0225966 A1 * 8/2013 Maci Barber ..... A61B 5/04085 600/388

* cited by examiner

Figure 9. Geometry change of interlaced interconnect during the punching process. a) Geometric shape of loops before punch test; b) geometric shape of loops in direct contact with the ball after punch test; c) geometric shape of loops out of contact with the ball after punch test.

STRETCHABLE ELECTRICAL INTERCONNECT AND METHOD OF MAKING SAME

TECHNICAL FIELD

The present invention relates to the field of stretchable electrical interconnects suitable for used in garments and the like, and methods of making same.

BACKGROUND OF THE INVENTION

There is a perceived demand for wearable electrical interconnects (also referred to as "circuit matrices") capable of carrying current or transporting charge in electrical systems which are suitably flexible and stretchable so as to contour to three-dimensional curvilinear surfaces of the human body in such applications as electronic garments, flexible displays, electronic artificial skins, and personal health assistants.

Typically, stretchable electrical interconnects are created by depositing and bonding the metal conductive films of the electrical interconnect on to rubber-like elastic substrates typically having out-of-plane wavy patterns or in-plane tortuous patterns. The elastic substrates are designed to provide some degree of flexing and stretching of the electrical interconnect around the human body. However, adhesive fractures tend to develop between the metal conductive films of the electrical interconnect and the elastic substrate due to flexing and stretching, and this can result in short-circuiting and subsequent electrical failure of the electrical interconnect. Some improvements have been proposed including levitating the delamination problem using polymer CNT or Graphene composites. However, the conductivity of these composites is not yet as high as metals. Furthermore, existing electrical interconnect structures are not well-suited for repeated flexing and stretching around three-dimensional curvilinear surfaces in the context of the above applications.

In addition to the conductive fibres forming the electrical interconnect, it is common for electrical components such as sensors, actuators, batteries and the like to also be electrically interfaced thereon. However, it can be problematic to interface the electrodes of the electrical components with the conductive fibres of the electrical interconnect by soldering techniques due to the fine and brittle nature of the electrical component electrodes and conductive fibres.

SUMMARY OF THE INVENTION

The present invention seeks to alleviate at least one of the above-described problems.

The present invention may involve several broad forms. Embodiments of the present invention may include one or any combination of the different broad forms herein described.

In a first broad form, the present invention provides an electrical interconnect including at least one electrically-conductive fibre configured to form a stretchable interlaced configuration.

Preferably, the stretchable interlaced configuration may include a knitted configuration.

Preferably, the electrically-conductive fibre may include at least one of a conductive polymer, a metal wire, an enameled metal wire, a metal wire coated in polyurethane, and a metal-coated textile yarn.

Preferably, the electrical interconnect may include at least one non-electrically-conductive fibre forming the stretchable interlaced configuration.

Preferably, the non-electrically-conductive fibre may include at least one of polyester, nylon, Spandex filaments, and a composite thereof.

In a second broad form, the present invention provides a coupling interface for use in electrically coupling an electrically-conductive fibre to an electrode of an electrical component, the coupling interface including:

a first portion configured for soldered coupling to the conductive fibre; and a second portion rigidly extending from the first portion, the second portion being configured for at least one of hooked and knotted coupling with the electrode of the electrical component.

Preferably, the first portion may include a cylindrical configuration.

Preferably, the cylindrical configuration may include a diameter of approximately 2 mm.

Preferably, the second portion may include a wire forming at least one of a ring and a loop configuration, the second portion being configured for the electrode of the electrical component to be hooked or knotted around it.

Preferably, the wire may include a diameter of approximately 1 mm.

Preferably, the present invention may include an electrically-conductive paste adapted for covering at least a coupling point between the coupling interface and at least one of the electrically-conductive fibre and the electrode of the electrical component.

Preferably, the electrically-conductive fibre may include an electrically-conductive fibre of an electrical interconnect.

In a third broad form, the present invention provides a method of forming an electrical interconnect including forming at least one electrically-conductive fibre into a stretchable interlaced configuration.

Preferably, the stretchable interlaced configuration may include a knitted configuration.

Preferably, the electrically-conductive fibre may include at least one of a conductive polymer, a metal wire, an enameled metal wire, a metal wire coated in polyurethane, and a metal-coated textile yarn.

Preferably, the electrical interconnect may include at least one non-electrically-conductive fibre forming the stretchable interlaced configuration.

Preferably, the non-electrically-conductive fibre may include at least one of polyester, nylon, Spandex filaments, and a composite thereof.

In a fourth broad form, the present invention provides a method of electrically coupling an electrically-conductive fibre to an electrode of an electrical component via a coupling interface, the method including the steps of:

soldering a first portion of the coupling interface to the conductive fibre; and hooking or knotting the electrode of the electrical component together with a second portion of the coupling interface rigidly extending from the first portion.

Preferably, the first portion may include a cylindrical configuration.

Preferably, the cylindrical configuration may include a diameter of approximately 2 mm.

Preferably, the second portion may include a wire forming at least one of a ring and a loop configuration.

Preferably, the wire may include a diameter of approximately 1 mm.

Preferably, the present invention may include the step of surrounding at least a coupling point between the coupling interface and at least one of the electrical wire and the electrode of the electrical component with an electrically-conductive paste.

Typically, the paste may include an elastomer including at least one of gold and carbon particles.

In a fifth broad form, the present invention provides a garment including an electrical interconnect formed in accordance with the first broad form of the present invention.

Advantageously, in the present invention the at least one conductive fibre is configured to form a stretchable interlaced configuration, for instance a knitted configuration, in which the at least one conductive fibre forms interlaced loops which are not bonded to an elastic substrate. Accordingly, the interlaced loops are free to slide and change their geometries within the structure of the stretchable interlaced configuration which may assist in maintaining the electrical properties when repeatedly flexed and stretched around three-dimensional curvilinear surfaces. In contrast, traditional approaches involve electrical interconnects being adhesively bonded to separate rubber or silicone-like substrates with curved shapes. In the existing art, the stretchability is limited by bonding integration which may easily cause stress concentration in the crest and trough parts of the elastic substrate.

Other advantages of the present invention includes that it involves a relatively simple structure, is relatively light weight and is relatively easy and cost-effective to fabricate using existing technologies. Furthermore, due to the interlaced integration between the electrically conductive fibres and the elastic fibres, the electrically conductive fibres have greater freedom to move and this alleviates stress concentration in the crest and trough parts of the knitted loops of the electrical interconnect. Also advantageously, as the electrical interconnect may be knitted, it is possible to form fabrics of arbitrary shapes in contrast to existing techniques which utilise woven interconnects.

Also advantageously, the coupling interface provides a relatively easier way to electrically couple a conductive fibre of an electrical interconnect with an electrical component such as a sensor. The first portion of the coupling interface may assist in providing a greater surface area to which the relatively fine and brittle electrically-conductive wire is able to be soldered. The second portion of the coupling interface may also provide a convenient point to which the relatively fine and brittle electrode of the electrical component can be hooked, tied, or knotted without requiring soldering. The additional use of an electrically-conductive paste to cover at least the coupling point between the coupling interface and at least one of the conductive fibre and the electrode of the electrical component may also assist in improving electrical conductivity. The paste may also include at least one of the following additional advantages of (i) providing strain relief between a coupled electrical component and an electrical interconnect (ii) being relatively inert to moisture so as to alleviate oxidisation (iii) assists in providing solderless bonding, and (iv) easily deformability to cover the coupling interface.

BRIEF DESCRIPTION OF THE DRAWINGS

The present invention will become more fully understood from the following detailed description of a preferred but non-limiting embodiment thereof, described in connection with the accompanying drawings, wherein.

DETAILED DESCRIPTION OF THE PREFERRED EMBODIMENTS

A first embodiment of the present invention will now be described herein with reference to FIGS. 1 to 21 in which a flexible and stretchable electrical interconnect is integrally formed by knitting a conductive copper wire with a plurality of elastic polyester fibres and Spandex filaments. A further embodiment of the present invention is also described with reference to FIGS. 22 and 23 in which a coupling interface is provided for coupling an electrical component such as a sensor to the electrical interconnect.

Traditional technologies adopt an approach in which electrical interconnects are adhesively bonded to separate rubber or silicone-like substrates with curved shapes. In the existing art, the stretchability is limited by bonding integration which may easily cause stress concentration in the crest and trough parts of the elastic substrate.

In contrast, the embodiments of the present invention are suitable for application in electronic garments and the like due to the ability of the knitted loops of the knitted electrical interconnect structure to accommodate repeated flexing and stretching around three-dimensional curvilinear surfaces such as parts of the human body in use without the electrical properties of the electrical interconnect substantially diminishing. Notably the metal wire is interlaced within the knitted electrical interconnect, instead of being bonded to a separate elastic substrate, such that the knitted loops of the electrical interconnect are able to slide and change their geometries when stretched. Therefore, the electrical properties of the metal wire within the electrical interconnect will be substantially maintained when repeatedly flexed or stretched to contour to three-dimensional curvilinear body shapes.

Figure 18:
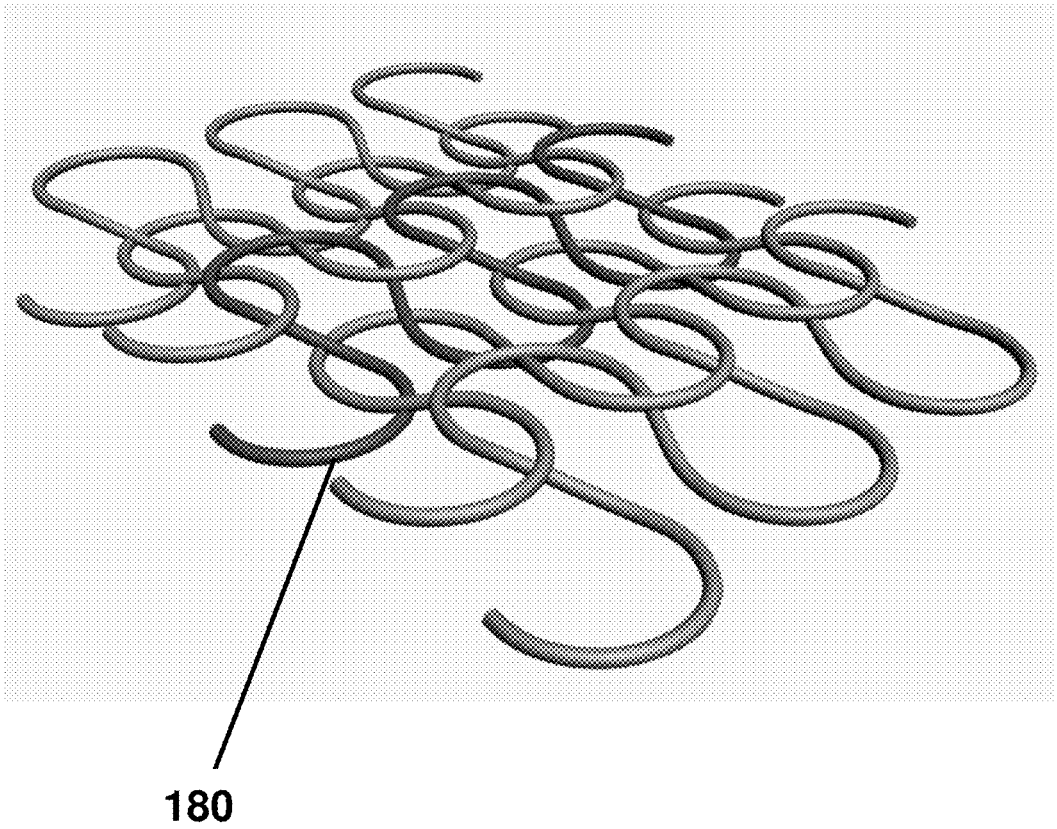
FIG. 18 represents a plain structure of a stretchable electrical interconnect formed in accordance with an embodiment of the present invention.
Figure 20A:
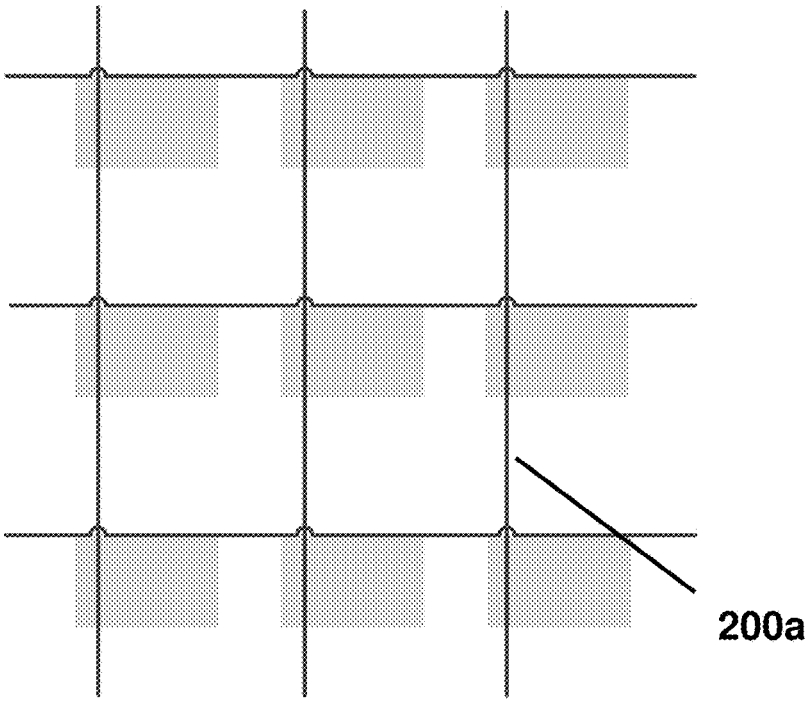
FIGS. 20(*a*)-20(*b*) depict different patterns of knitted electrical interconnects formed in accordance with embodiments of the present invention including a matrix pattern and an array pattern, respectively.
Figure 20B:
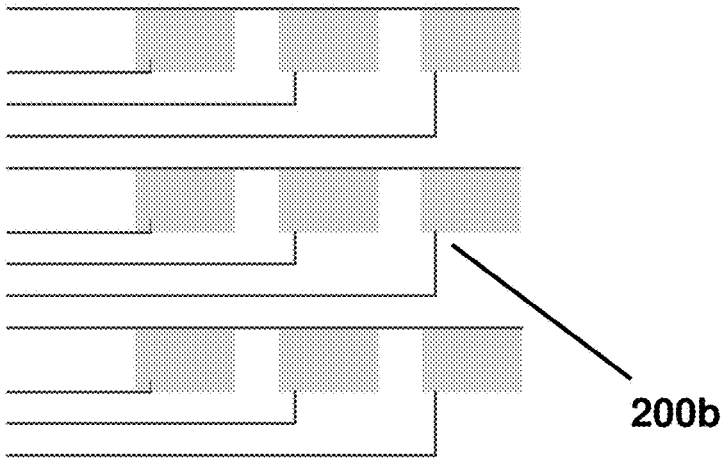

The electrical interconnect is fabricated by co-knitting a super-fine enameled metal wire together with polyester and elastic Spandex filaments in to a plain, rib, interlock or any other knitted configuration having interlaced knitted loops (180) similar to that as shown in FIG. 18. The metal wire can be knitted into the fabric such that it lies in both course (i.e. horizontal) and wale (vertical) directions which can be realised by utilising an intarsia knitting pattern. When knitted into the electrical interconnect, the metal wires can form either a matrix pattern (200*a*) as shown in FIG. 20(*a*) or an array pattern (200*b*) as shown in FIG. 20(*b*).

Figure 4:
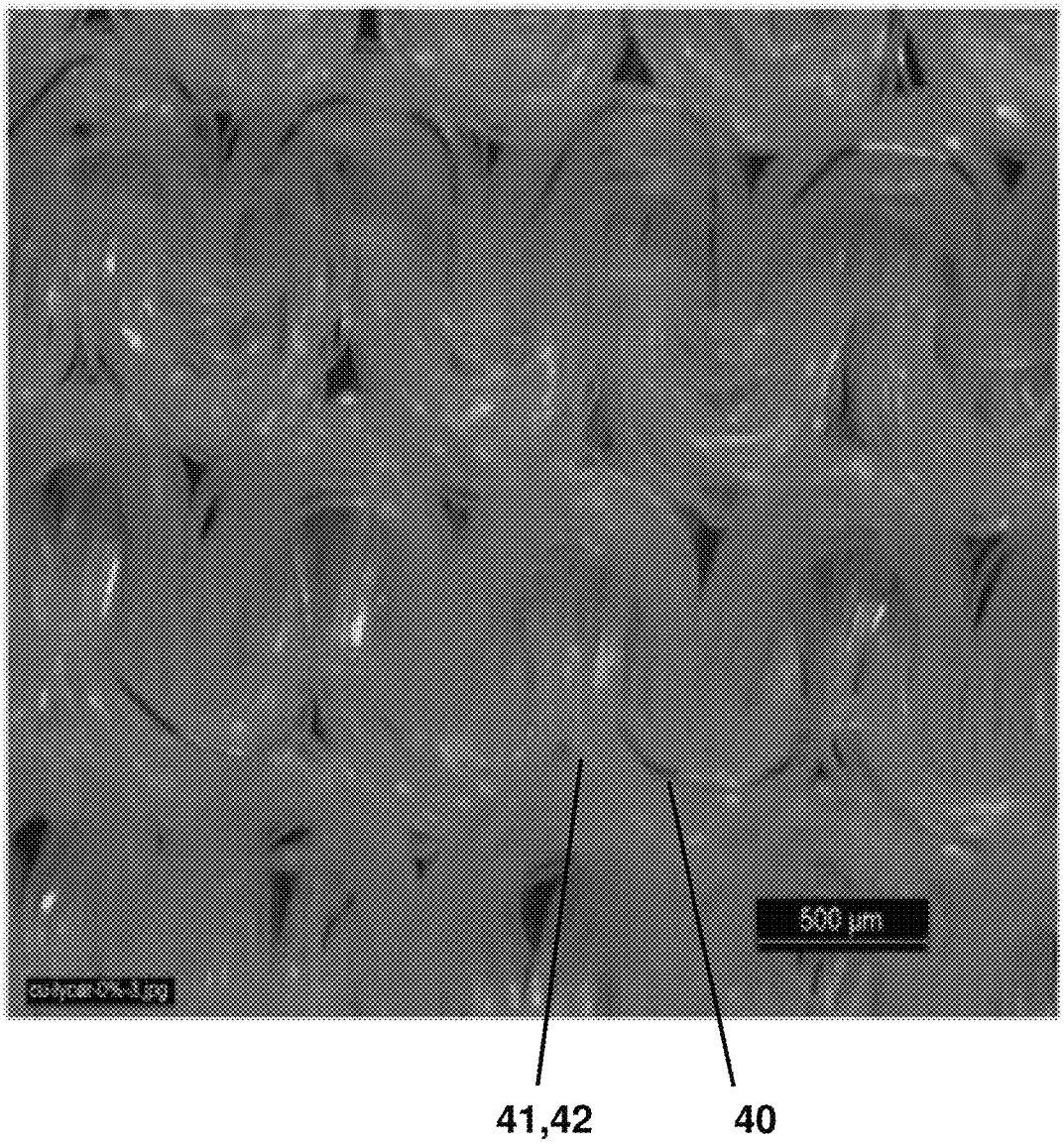
FIG. 4 shows a microstructure of an interlaced electrical interconnect in accordance with embodiments of the present invention.

FIG. 4 shows a micro-structure of the interlaced electrical interconnect in which the metal wire (40), the polyester fibre (41) and Spandex filaments (42) are integrally formed in the course (i.e. rows of loops). Since the tensile strength of the super fine copper wire is less than 0.1N with the core diameter of 20 μm (see FIG. 2), polyester and under-fed Spandex filaments are fitted into the same course for a reliable manufacturing operation.

Figure 3:
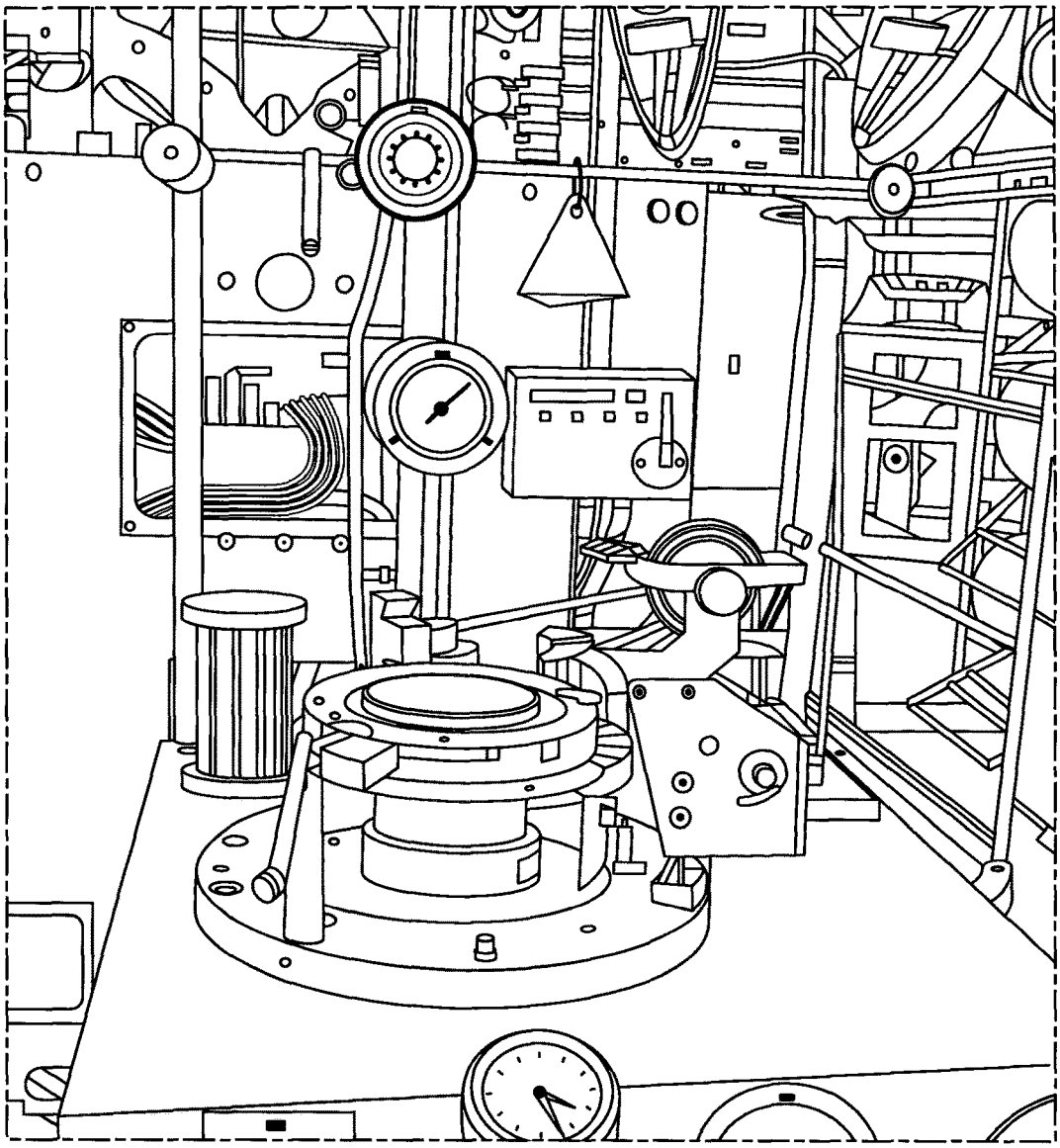
FIG. 3 shows an exemplary weft circular knitting machine used to form a knitted electrical interconnect in accordance with embodiments of the present invention.
Figures 19A, 19B:
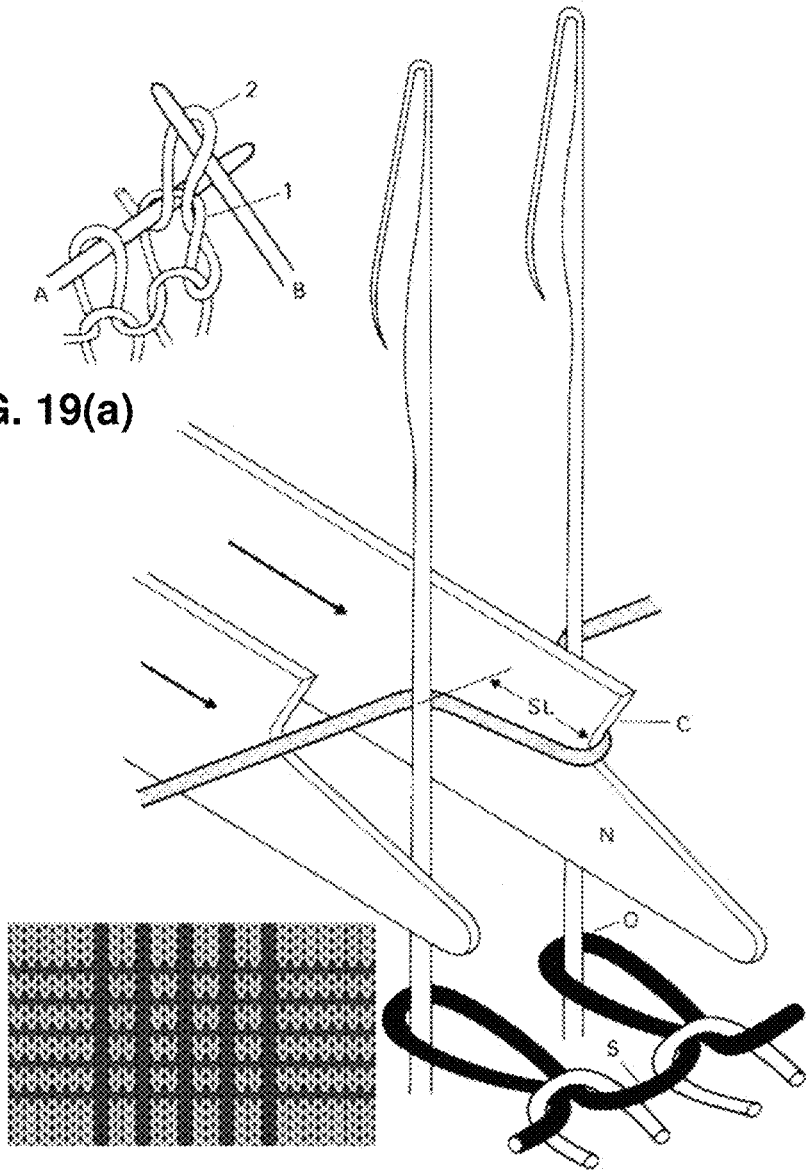
FIGS. 19(*a*)-19(*b*) depict exemplary processes for knitting the interlaced electrical interconnect in accordance with embodiments of the present invention including hand-knitting, and, machine knitting.

The knitting process may be performed either by hand as shown in FIG. 19(*a*), or more conveniently, by using a weft circular or a flat knitting machine as shown in FIG. 3 and FIG. 19(*b*).

The super-fine enameled metal wire used in these embodiments includes super fine enameled copper wire such as that produced by Shanghai, Gold Ever Super Fine Enameled Wire Co., Ltd, China. In alternative embodiments, other suitably conductive metal wires including silver or gold could be used. Advantageously, such enameled metal wires are suitably flexible to be integrated into a knitted elastic substrate of the electrical interconnect and are also insulated by polyurethane films so as to alleviate risk of short-circuiting when the elastic substrate is stretched in vertical directions. The copper wire has a range of diameter from between 20 μm-80 μm and is coated by polyurethane with a thickness of several micrometers.

Figure 1:
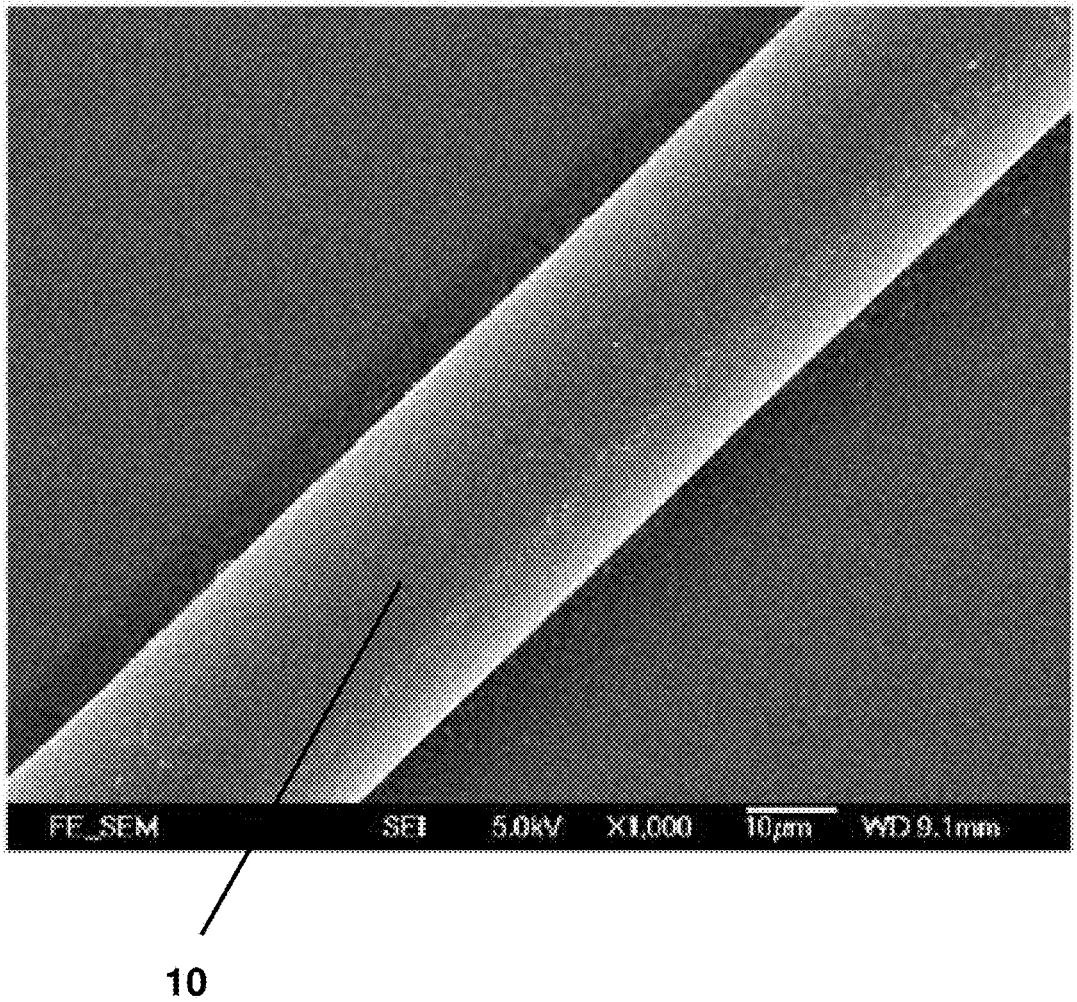
FIG. 1 depicts an SEM micrograph of an enameled copper wire as used in accordance with embodiments of the present invention.
Figure 2:
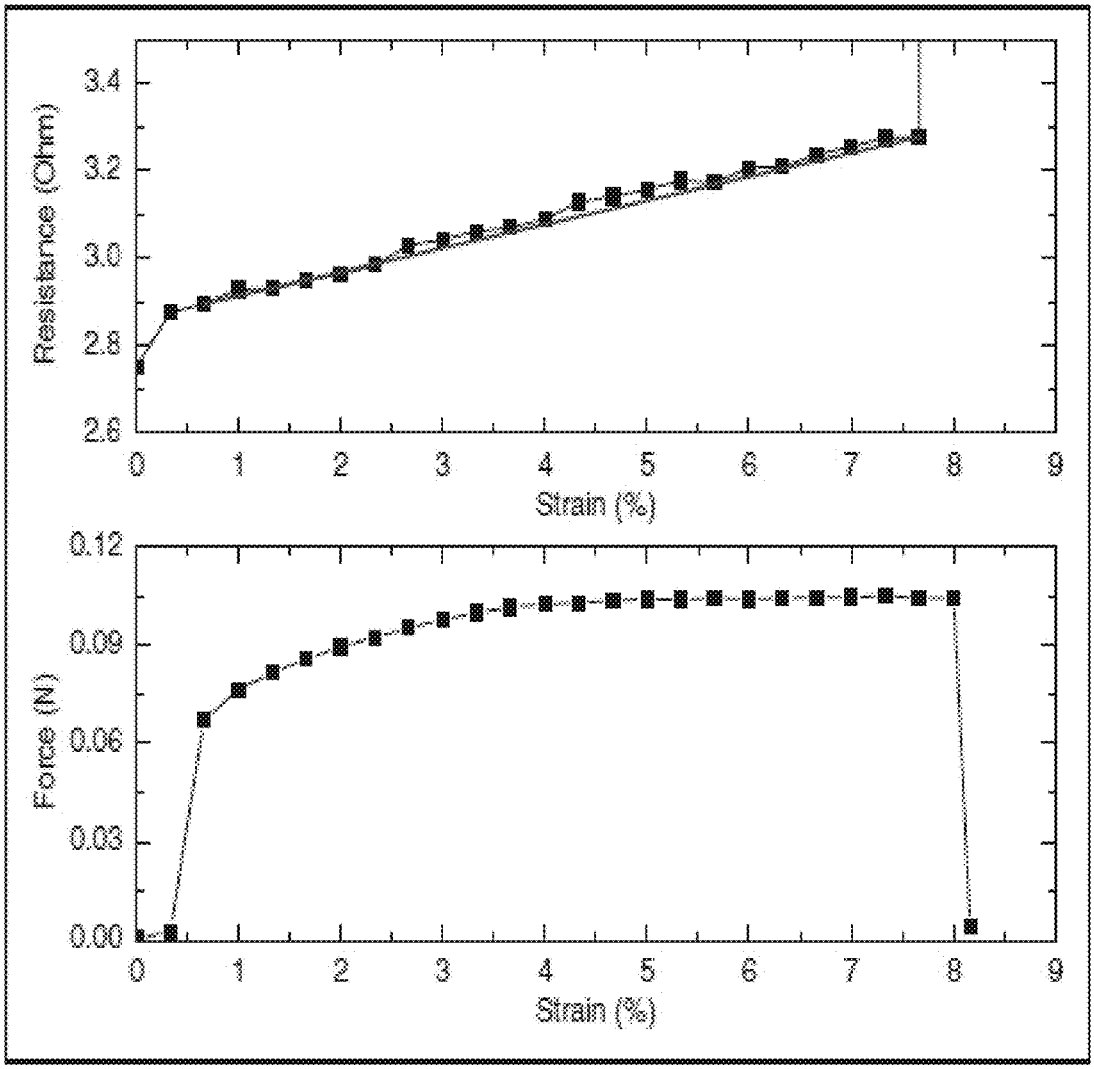
FIG. 2 is a chart representing electro-mechanical properties of the enameled copper wire shown in FIG. 1 with a core diameter of 20 μm.

The SEM micrograph in FIG. 1 shows an exemplary enameled copper wire (10) with a core diameter of 20 μm as used in embodiments of the present invention. The surface of the wire is smooth although there may be certain tiny impurities due to imperfect manufacturing conditions, and the enameled copper wire (10) remains intact after being interlaced within the knitted structure. Typically, the unit resistance of a wire of 20 μm is 0.55 ohm/cm. FIG. 2 represents the electro-mechanical properties of this enameled copper wire. Its initial resistance is about 2.75 ohm for a length of 5 cm, increasing by 19.27% to 3.28 ohm just before its electrical failure, which occurs at 7-8% strain with 0.1 N. The resistance of the enameled copper wire, Rc, during tensile testing can be expressed by the equation:

$$R_C = R_0 + k\in \quad (1)$$

where k is constant ($k \approx 0.05$) and $\in$ represents the strain.

In embodiments of the present invention, the knitted polyester and elastic Spandex filaments assists in providing an elastic substrate for the electrical interconnect. The dielectric constant of the polyester is around 3.2. The knitted substrate with Spandex filaments is able to undergo repeated large-scale deformation before fracturing occurs (>300% strain). Also, it is relatively flexible and conformable to movable curvilinear body shapes. Furthermore, it is of relatively low cost to produce when utilising efficient manufacturing technologies.

A three-dimensional punch test is employed to demonstrate the suitability of the interlaced electrical interconnect for use in contouring to three-dimensional curvilinear bodies. The experimental results demonstrate that the electrical integrity of the interlaced electrical interconnect is able to be maintained while being three-dimensionally deformed during cyclic punch tests. Several parameters of the stretchable interconnect, including diameters of the conductor, content of elastic Spandex fibres, and fabric structure, have been studied experimentally and are disclosed in further detail below.

Figure 5:
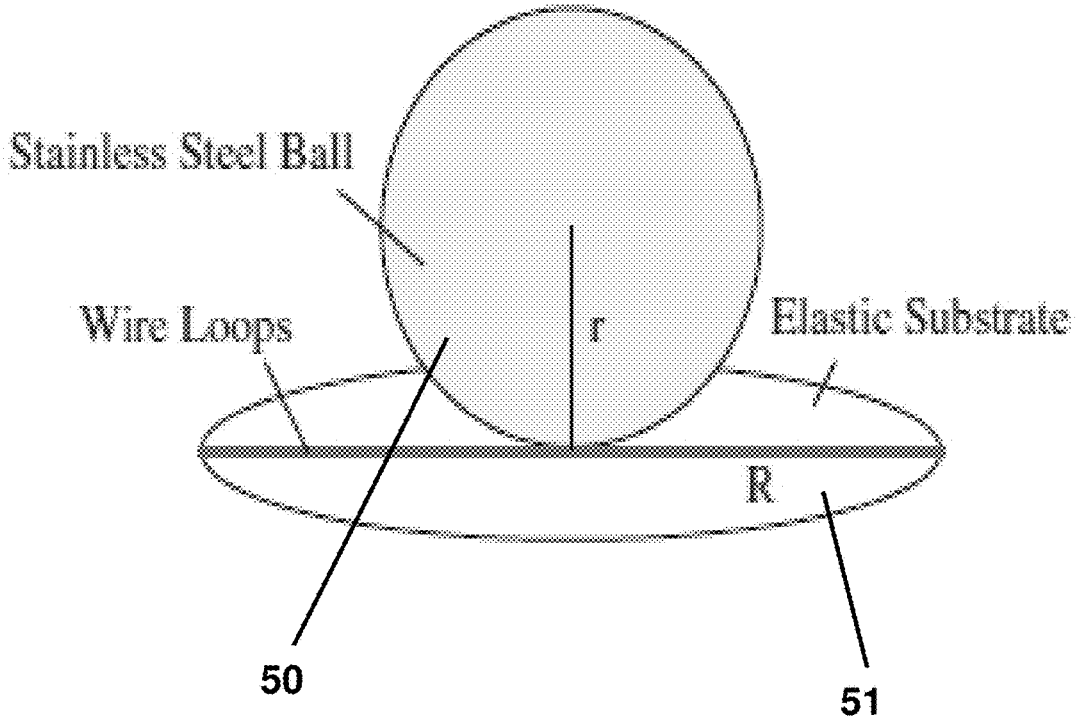
FIG. 5 shows a schematic diagram of a three-dimensional punch test as applied during testing of embodiments of the present invention.

To demonstrate the ability of embodiments to warp around curvilinear shapes and to suitably accommodate to the movement of a subject, a three-dimensional ball-punch test applicable for textile fabrics is employed. The ball-punch instrument consists of a clamping mechanism to hold the test sample and a stainless steel ball (50) attached to the movable member of a Universal Materials Tester, Instron. The polished stainless steel ball (50) used in the tests has a diameter of 25.400±0.005 mm and is spherical. The ring clamp has an internal diameter of 44.450±0.025 mm. A schematic diagram of the three-dimensional punch test arrangement is illustrated in FIG. 5.

Figure 6:
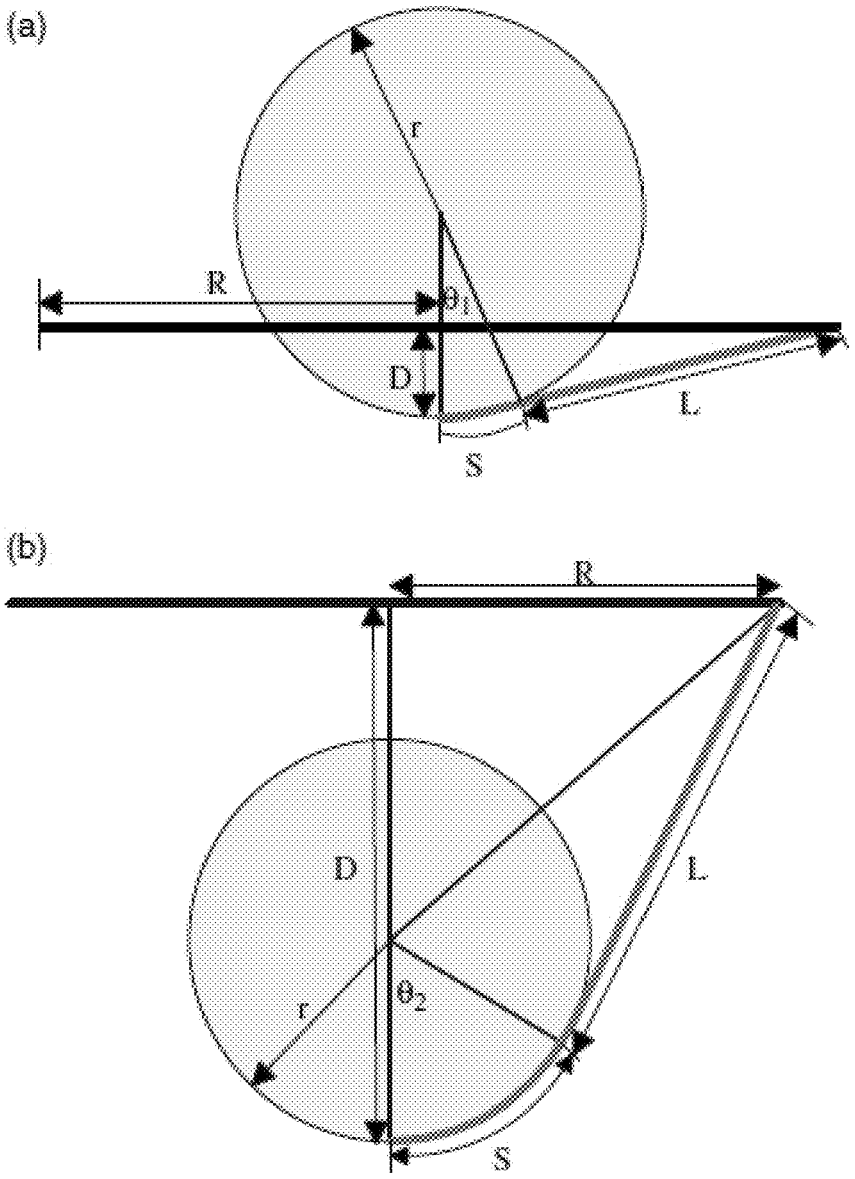
FIG. 6 shows relevant parameters used in the mathematical analysis of the three-dimensional punch test.

The stainless steel ball (50) is pushed into the interlaced electrical interconnect (51) sample with the displacement of the ball and force being recorded by the Instron. The resistance of the stretchable interconnect (51) is recorded simultaneously by a multimeter. In the area where the electrical interconnect is out of contact with the ball (50), as the electrical interconnect is very thin in thickness compared with its other dimensions, the major deformation mode can be considered as membrane stretching. In the area where the electrical interconnect (51) is in direct contact with the ball (50), a complex process emerges involving bending, shearing, lateral compression, and friction as well as membrane stretching of the electrical interconnect. To simplify the analysis, an average membrane strain is used for the interlaced electrical interconnect (51). The total length of the sample in the deformation process is divided into two separate elements: L and S. As illustrated in FIGS. 6(*a*) and (6*b*), the right half of the sample is studied as the whole measurement setup is symmetrical. In FIG. 6(*a*) D<r and in FIG. 6*b*) D>r. According to the principal properties of right triangle, L can be expressed by the equation:

$$L=\sqrt{D^2+R^2-2Dr} \tag{2}$$

where D presents the vertical displacement of the bottom point of the stainless steel ball, R and r represent the radius of the ring clamp and the ball respectively.

The arc length of the contacting region between the ball and fabric is represented by the symbol S. When the displacement D is less than the radius of the ball, r, the corresponding radian $\theta_1$ of arc length S can be calculated by the equation:

$$\theta_1=\arctan\,[R/(r-D)]-\arctan(L/r) \tag{3}$$

When the displacement of the ball, D, is larger than the radius of the ball, r, the corresponding radian, $\theta_2$, will be expressed by the equation:

$$\theta_2=\pi-\arctan\,[R/(D-r)]-\arctan(L/r) \tag{4}$$

The arc length of the contacting region between the ball and fabric, S, can be determined by the equation:

$$S=r\theta_{1/2} \tag{5}$$

Thus, the average strain of the sample $\overline{\in}$ during the ball punch test can be determined by the equation:

$$\overline{\in}=(L+S-R)/R\times 100\% \tag{6}$$

Figure 7:
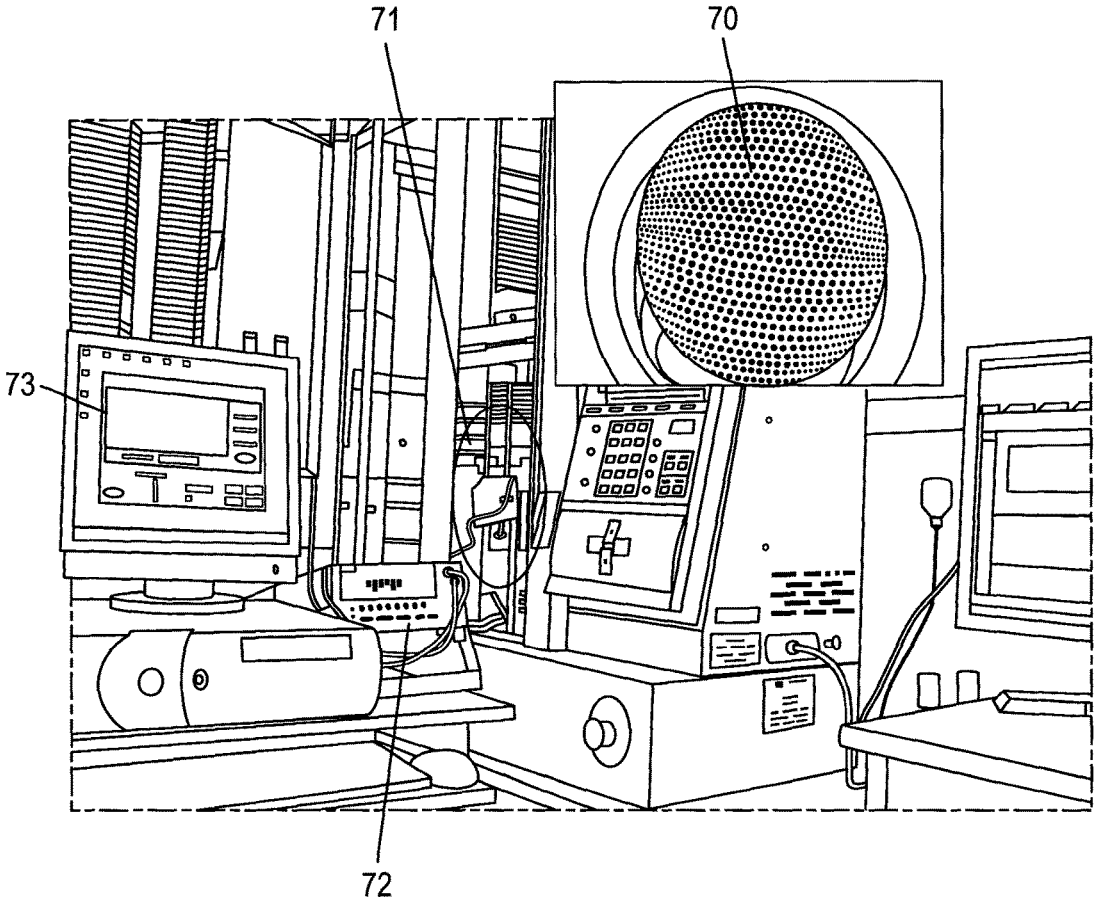
FIG. 7 shows an exemplary setup used for conducting the three-dimensional punch test.

As depicted in FIG. 7, a sample (70) of the interlaced electrical interconnect is securely fastened in the ring clamp without tension. The course containing the metal conductor wire is in the middle part of the sample, which is achieved by marking the same circle as the shape of the clamp on the sample before putting the sample into the clamp (71). The metal conductor wire is connected to a digital multimeter (72) interfaced with a personal computer (73). The electrical resistance is recorded simultaneously when the sample is three-dimensionally deformed by an Instron Universal Material Tester with the ball-punch attachment.

Figure 8:
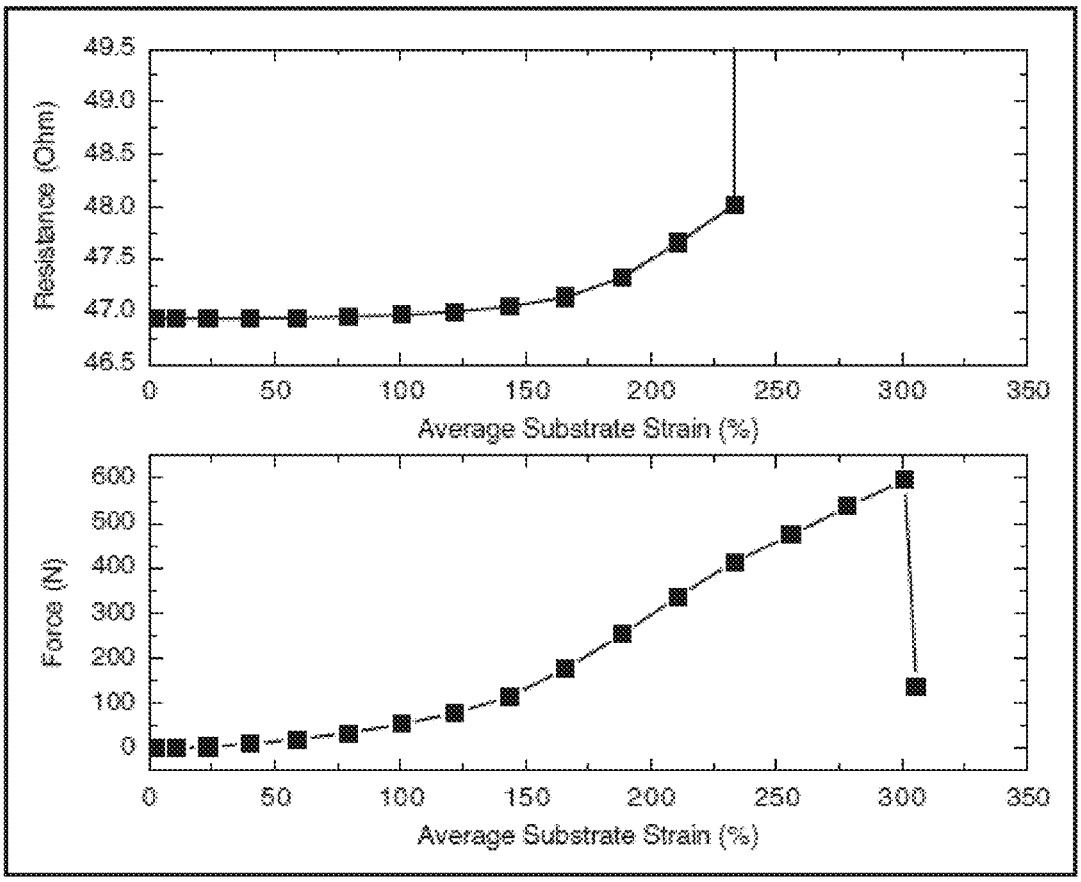
FIG. 8 shows electrical and mechanical properties of an interlaced electrical interconnect in accordance with an embodiment of the present invention.

In the first three-dimensional ball punch measurement, the interlaced electrical interconnect is stretched until it fails either electrically or mechanically. The ball is pushed into a sample at the speed of 300 mm/min. The electrical resistance is recorded at intervals of 100 ms. FIG. 8 represents the electrical and mechanical behaviour of one tested sample as a function of applied average strain, which is calculated using equations 2 to 6 above. The knitted elastic substrate can be stretched up to 300% strain with a peak force of 600N on a movable stainless steel ball. The interlaced electrical interconnect is capable of maintaining stable electrical resistance until being stretched beyond an average elongation of 100%, which is one third of the mechanical breaking strain of the elastic substrate.

Figure 9:
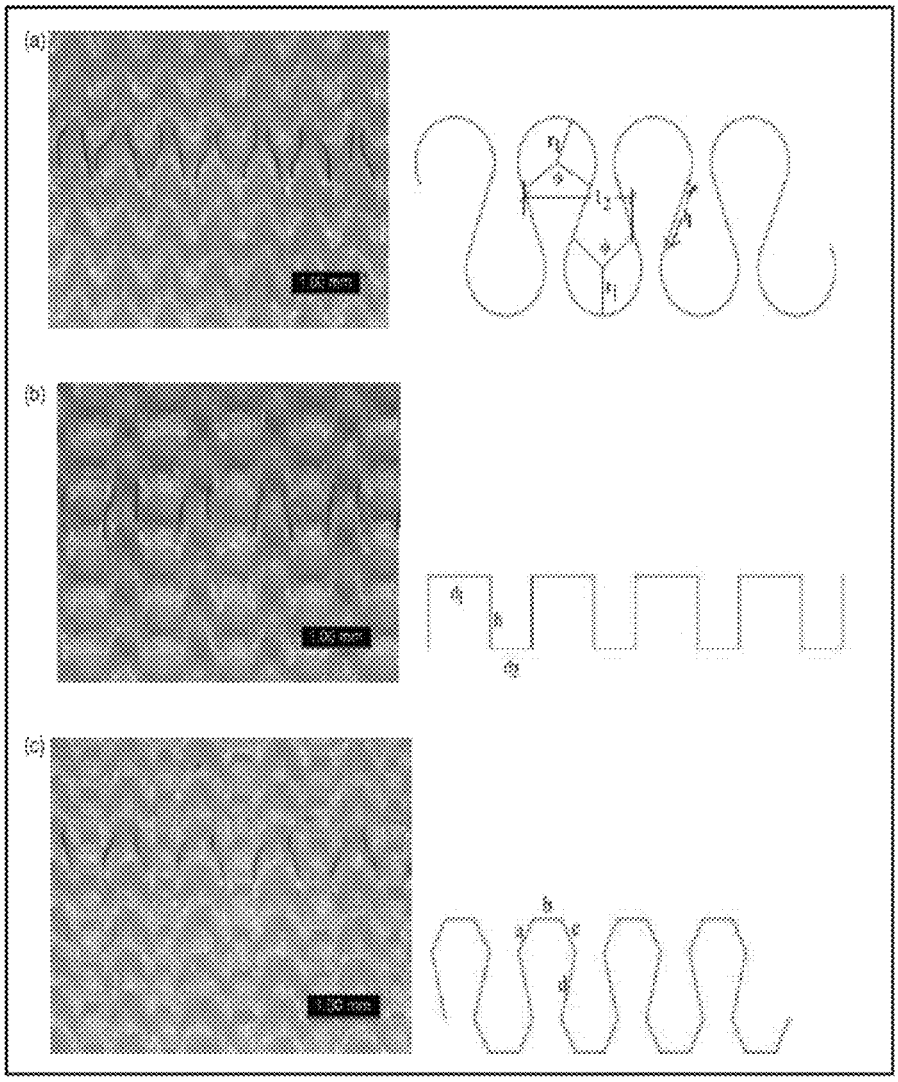
FIGS. 9(*a*)-9(*c*) depicts changes in the geometry of an interlaced electrical interconnect formed in accordance with embodiments of the present invention, in response to the three-dimensional punch test.

Such satisfactory performance can be attributed to the interlaced integration between the copper wire and the elastic substrate, which is realised by the knitted structure. When the knitted structure is stretched two-dimensionally, three general deformation stages exist in the force-displacement curve. Intra-yarn or inter-fibre friction is most influential at the initial stage; yarn bending or 'straightening' is prominent for the major region of the curve, where curved yarns tend to de-bent to straight ones. Finally, yarn lateral compression and axial extension become most dominant in the latter part of the curve. When the interlaced electrical interconnect, covering a three-dimensional stainless steel ball, is stretched within 100% strain, two obvious phenomena occur. Firstly, the geometric shape of every loop will change; secondly, the segments of yarns including the copper wire have the freedom to transfer between the loop legs. As represented in FIG. 9(*a*), the copper wire has a uniform loop configuration before the punch test without being stretched. The length of every loop, $l_{lo}$, can be expressed by the equation:

$$l_{lo}=2r_1(2\pi-\phi)+2l_1 \tag{7}$$

where $r_1$ is the radius of up and down circles, $l_1$ is the distance between the up and down circles. Therefore, the total length of the Conductor, $l_c$, can be obtained approximately by the equation:

$$l_c=l_{lo}l_s/l_2 \tag{8}$$

where $l_s$ is the total length of the knitted electrical interconnect, and $l_2$ is the distance between two adjacent loops. When it is punched by the ball, a complex process occurs where bending, shear, membrane stretching and lateral compression are present at various segments of the loops. The geometry of the loops will change non-uniformly. FIG. 9(*b*) shows the geometric shape of rectangular loops in direct contact with the ball when the sample is stretched to about 40% average strain. Here, the length of every unit $l_{u1}$ can be expressed by the equation:

$$l_{u1}=d_1+d_2+2h \tag{9}$$

However, the loops out of contact with the steel ball have a different geometric change. FIG. 9(*c*) illustrates the hexagon-like configuration. Here, the length of every unit $l_{u2}$ can be determined by the equation:

$$l_{u2}=2(a+b+c+d) \tag{10}$$

Therefore, the total length of the copper wire after being three-dimensionally deformed $l'_c$ can be expressed by the equation:

$$l'_c=\Sigma l_{u1}+\Sigma l_{u2} \tag{11}$$

Thus, the average axial strain of the copper wire $\overline{\in_r}$ in the three-dimensional punching experiment can be determined by the equation:

$$\overline{\in_c}=(l'_c-l_c)/l_c\times 100\% \tag{12}$$

The copper wire is stretched axially while the transfer of loop segments occurs. To determine the equivalent strain of the copper wire, the loop length is measured before and after the three-dimensional punch test. The mean axial strain of the copper wire for elongations is summarised in Table 1 below as follows:

TABLE 1

Mean axial strain of metal wire with different elongation of knitted substrate

| | Average substrate elongation (%) | | | |
|---|---|---|---|---|
| | 40 | 78 | 120 | 160 |
| Average axial strain of wire (%) | 0.568 | 0.683 | 0.747 | 0.948 |

This is consistent with other samples of embodiments tested whereby the maximum fibre strain, measured by a Raman microscope, is found to be less than 1% when the fabric is extended to 30%.

Beyond 100% strain, the electrical resistance increases almost linearly with the average strain, which is similar to the tensile behaviour of the enameled copper wire shown in FIG. 2. It is also observed that the knitted elastic substrate is still able to be stretched after electrical failure, which suggests that such a highly flexible and stretchable substrate is appropriate for elastic electronics on deformable curvilinear bodies.

Figure 10:
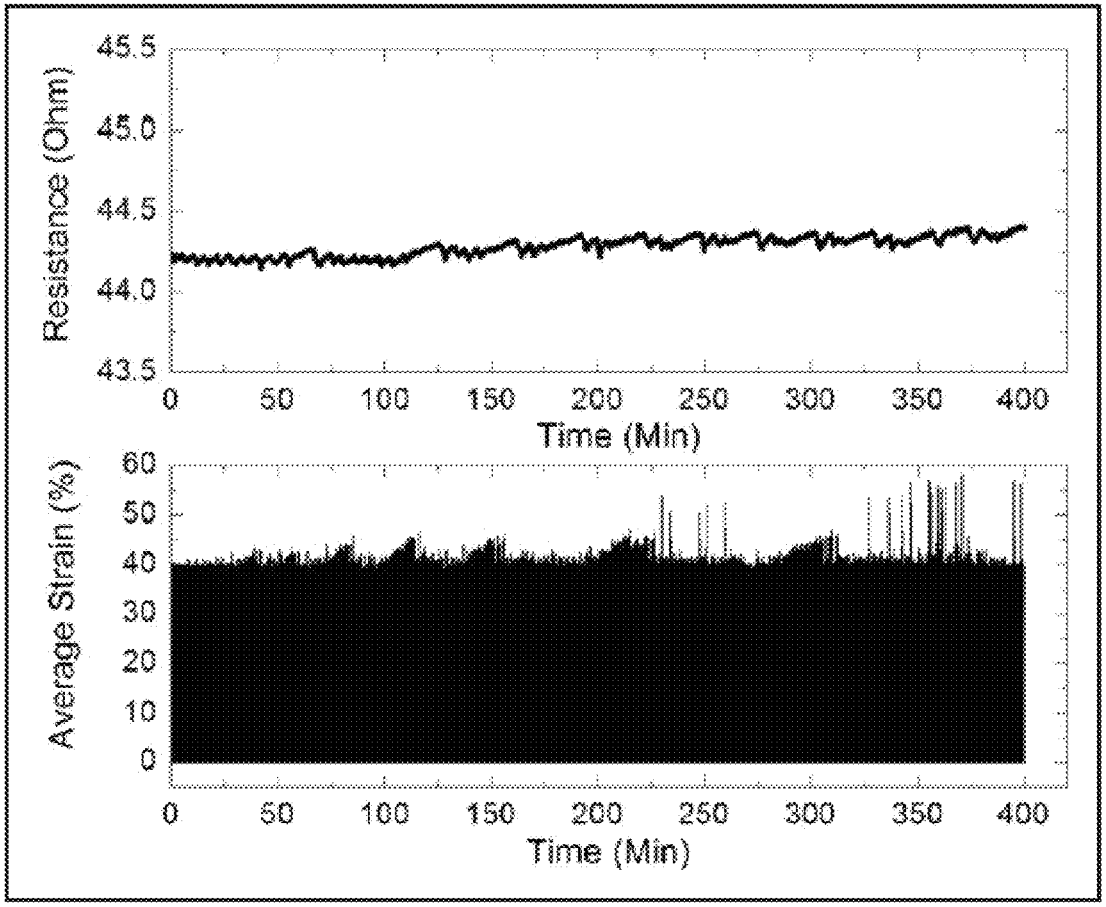
FIG. 10 shows a chart depicting results of a cyclic electro-mechanical test performed upon an embodiment of the present invention.

The durability of the interlaced electrical interconnect in the three-dimensional cyclic punch test is demonstrated too. The ball is pushed into the sample with a speed of 500 mm/min. As illustrated in FIG. 10, in the 5000 cycles, with a maximum displacement of 22 mm (about average 46% strain of the substrate), the minimum and maximum resistance of the sample is 44.15 ohm and 44.35 ohm, respectively. The variation of the resistance is 0.45% calculated by:

$$(R_{max}-R_{min})/R_{max}\times 100\% \quad (13)$$

In alternative testing of embodiments, a stainless steel ball is cyclically punched in to a knitted fabric at a speed of 500 mm/min. In the 1250 cycles with an average of 160% strain of knitted fabric, the minimum and maximum resistance of the embodiment is 9.17 Ohm and 9.30 Ohm respectively. The variation of the resistance is 1.40% calculated by equation 13 which suggests that the knitted fabric embodiment is quite durable.

Evidence from the above experimental tests suggests that the interlaced electrical interconnect is durable with electrical integrity on repeated deformed curvilinear shapes. To determine the fatigue time of the interlaced electrical interconnect, a three-dimensional cyclic punch test is performed on two to four samples at given nominal displacements (strain) before electrical failure. The mean lifetime of the interlaced interconnect is observed.

Figure 11:
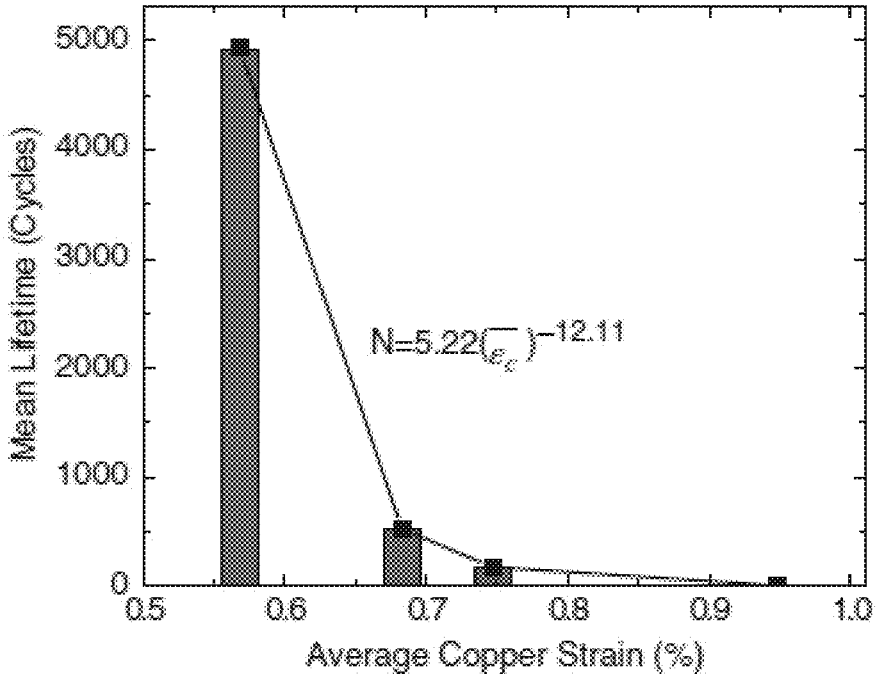
FIG. 11 shows life cycles of an interlaced electrical interconnect using 20 μm formed in accordance with an embodiment of the present invention.

FIG. 11 describes the average life cycles of the interlaced electrical interconnects with average applied strain from 40% to 200%. At 40% average strain, the sample with 20 μm-diameter copper wires survived 5000 punch cycles. To estimate the fatigue life of the interlaced interconnects, the Coffin-Manson law is used. The mean lifetime of the interlaced electrical interconnects is a function of fibre strain and can be estimated by the equation:

$$N=5.22(\overline{\epsilon_c})^{-12.11} \quad (14)$$

To accommodate the movement of the samples with curvilinear surfaces, elastic electrical interconnects are required to be highly conductive, stretchable, and electrically stable with a long fatigue, time. The interlaced electrical interconnects described in the previous section shows the potentials, with satisfactory stretchability and durability, covering deformed curvilinear bodies. To further improve performance, the effects of several parameters are examined on the functions of the interlaced electrical interconnect. These parameters included the diameter of the enameled copper wire, the amount of Spandex filament, and the gauge of the knitting machine.

Interlaced electrical interconnects are fabricated using copper wires with various diameters from 20-80 μm. Initial resistance, stretchability and durability in the three-dimensional punch test were evaluated using the samples with a length of 25 cm.

Figure 12:
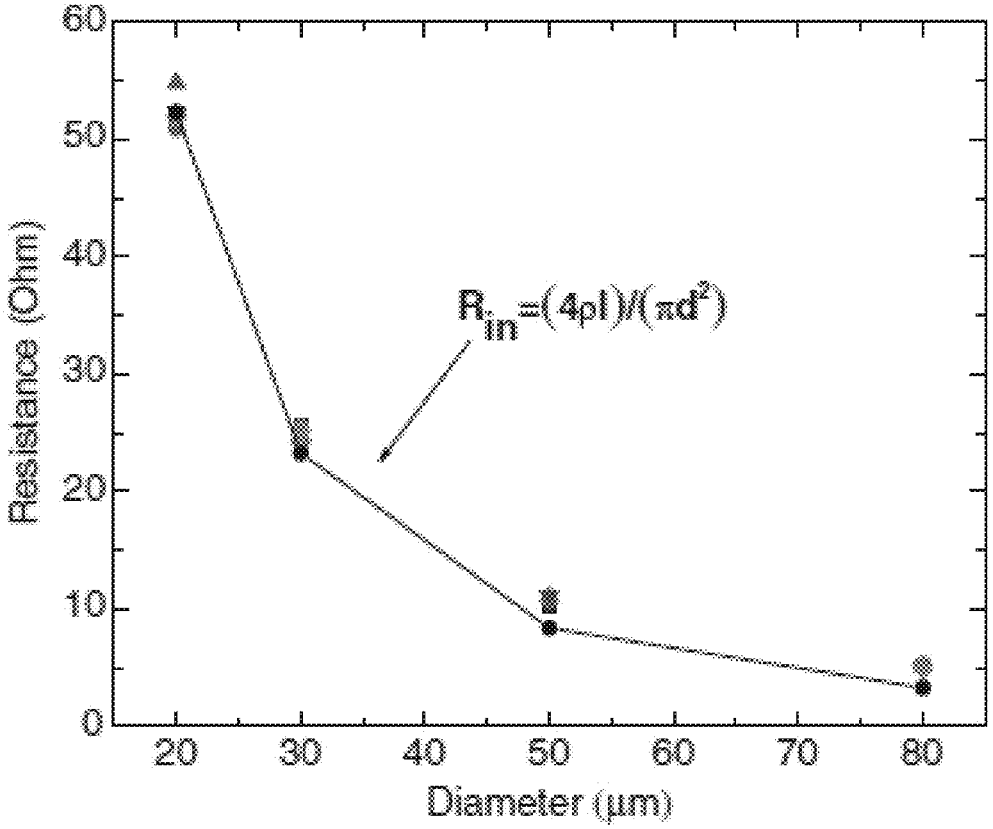
FIG. 12 shows a chart depicting initial resistance of interlaced electrical interconnects having different diameters of copper wires formed in accordance with embodiments of the present invention.

FIG. 12 verifies that the initial resistance, $R_i$, of those interconnects follows the law of resistance of a conductor with a uniform cross-section, i.e., $$R_i=4\rho l/(\pi d^2) \quad (15)$$

where l is the loop length of the enameled copper wire in the electrical interconnect and d is the diameter of the copper wire. Therefore, for the same sample length, the interlaced electrical interconnects made from the coarser copper wires are more conductive.

Figure 13:
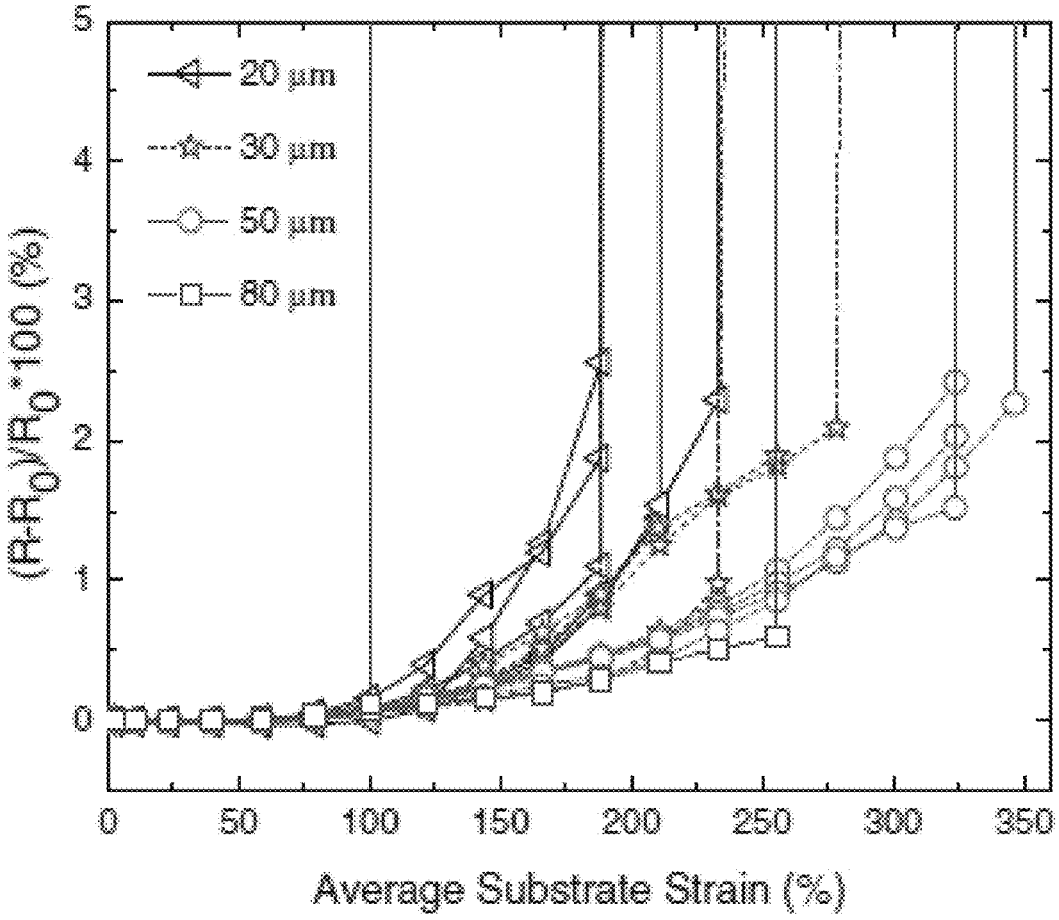
FIG. 13 shows a chart representing relative change in resistance of interlaced electrical interconnects having different diameters of copper wires formed in accordance with embodiments of the present invention.
Figure 14:
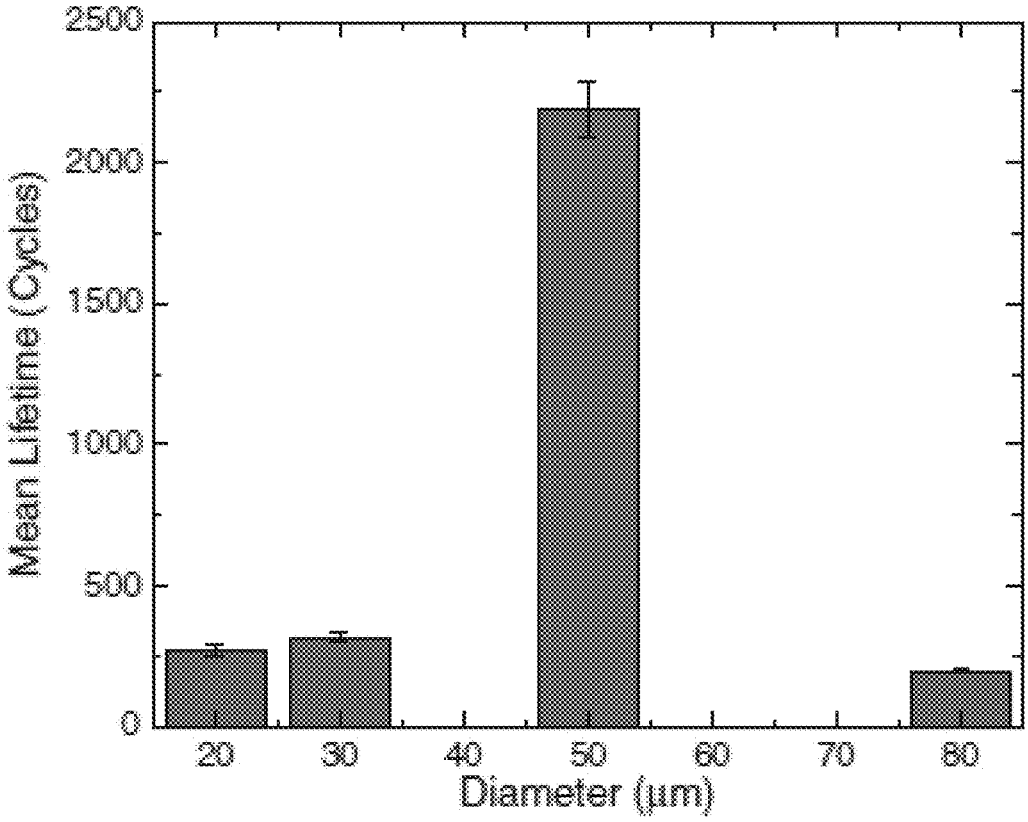
FIG. 14 shows a chart representing mean life cycles of interlaced electrical interconnects having different diameters of copper wires formed in accordance with embodiments of the present invention when subjected to 78% average fabric strain during testing.

Finer wires are able to be stretched more than coarser wires along the axial direction in a unidirectional tensile test. However, in the three-dimensional punch tests, the electrical interconnect samples made from 50 μm copper wires have the largest stretchability before electrical failure, as depicted in FIG. 13. This unique phenomenon becomes more obvious in analysis of fatigue time measurement. FIG. 14 shows the mean life time of the interlaced electrical interconnects made from enameled copper wires with various diameters at 78% average strain. The samples with the diameter of 50 μm are observed to be more durable under the cyclic three-dimensional punch tests in contrast to those made from relatively finer wires.

Figure 15:
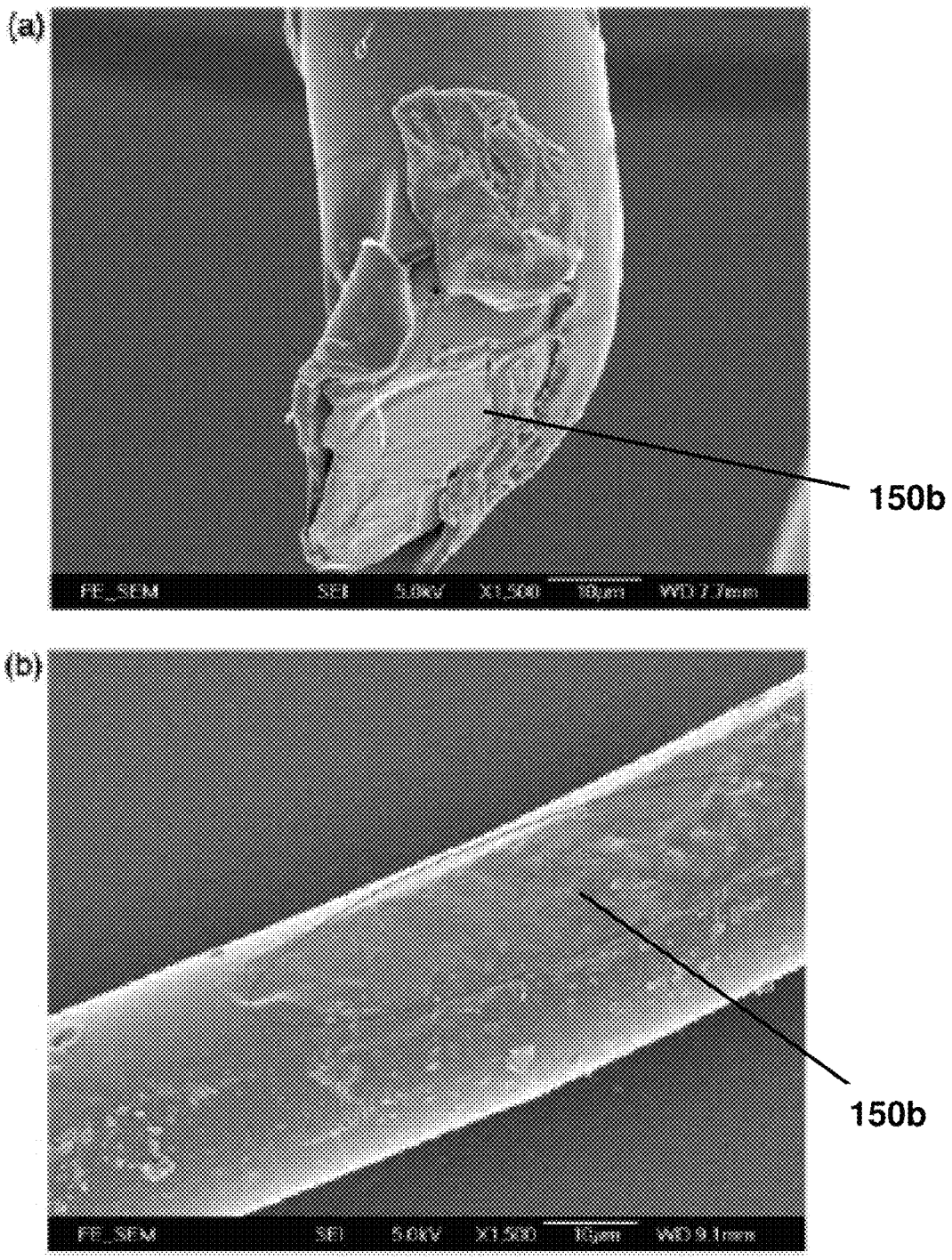
FIGS. 15(*a*)-15(*b*) are microstructure diagrams depicting the damage caused to the copper wire by mechanical compression, and, by friction between the copper wire and the stainless steel ball respectively, during fatigue testing of embodiments of the present invention.

This unexpected result prompted further investigations. Based on a theoretical analysis of the geometric change of the loop configuration during the three-dimensional punch test, strain distribution of the copper wire has several components: those due to bending, lateral compression, torsion, and axial tension as well as the local strain due to mechanical compression and friction between the wire and the stainless steel ball. The strain of the copper wires plays a critical part in stretchability and durability of the interlaced interconnects. In a pure tensile test, without mechanical compression and friction between the copper wire and the steel ball, a finer copper wire has a lower bending and torsional rigidity thus the corresponding strain components are small. Hence it is expected that the finer wire would be more durable. However, in the three-dimensional punch test, fatigue is firstly caused by the mechanical abrasion due to a high level of lateral compression and friction between the copper and the ball. FIGS. 15(*a*) and 15(*b*) illustrate the damage to the enameled copper wire after the fatigue test with 78% average strain. It is evident that mechanical abrasion between the ball and the substrates occurred within the area in direct contact with the stainless steel ball. The wire is subjected to localised twist and rubbing. No failure occurs in the area where the fabric is not in direct contact with the ball. In other words, the fatigue is mainly caused by the mechanical abrasion due to high levels of compression and friction between the ball and the substrates rather than the action of cyclic membrane stretching. Therefore, the effect of mechanical compression and friction override that of fibre diameters leading to the different life times of the interlaced electrical interconnects. FIG. 15(*a*) shows the damage (150*a*) resulting from mechanical compression between the wire and ball whilst FIG. 15(*b*) shows the damage (150*b*) resulting from mechanical friction between the wire and ball.

Figure 16:
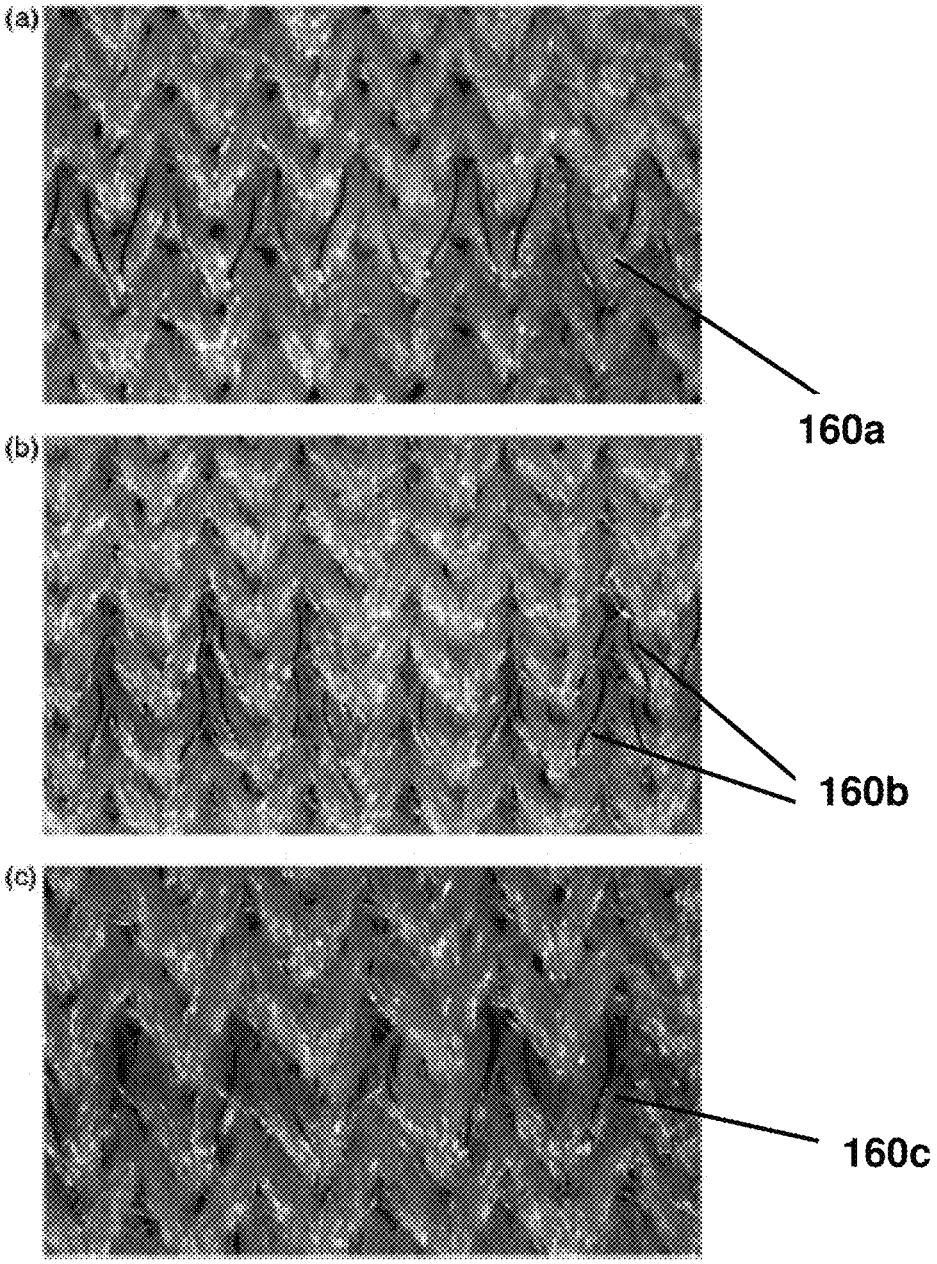
FIGS. 16(*a*)-16(*c*) depict interlaced electrical interconnects in accordance with embodiments of the present invention in which a single copper wire has been used, double wires in two-courses have been used, and double wires in a single course have been used, respectively.

Multiple copper wires can be integrated into the knitted electrical interconnect structure to accommodate large electric currents. FIG. 16(*a*)-(*c*) illustrates the interlaced electrical interconnects made from single/multiple copper wires with a diameter of 30 μm. In particular, FIG. 16(*a*) shows the interlaced interconnect utilising a single copper wire (160*a*), FIG. 16(*b*) shows the interlaced interconnect utilising double wires in two courses (160*b*), and FIG. 16(*c*) shows the interlaced interconnect utilising double wires in one course (160*c*). The conductor in the interlaced electrical interconnect is comprised of one or two copper wires in two courses, and two copper wires in one course. Table 2 below indicates the performance in initial resistance with the length of 25 cm and fatigue time at about 78% strain. The initial resistance decreases to half by doubling copper wires, which is expected. Life cycles of the samples with double wires in two courses were twice of those with a single wire. However, the conductivity and fatigue time were still far away from interlaced electrical interconnects made from single 50 μm copper wire.

TABLE 2

Resistance and life time of the samples

| Samples | Resistance (ohm) | Mean life time (cycles) |
|---|---|---|
| Single wire | 24.9 | 308 |
| Double wires in two courses | 12.6 | 698 |
| Double wires in one course | 12.8 | 472 |

Figure 17:
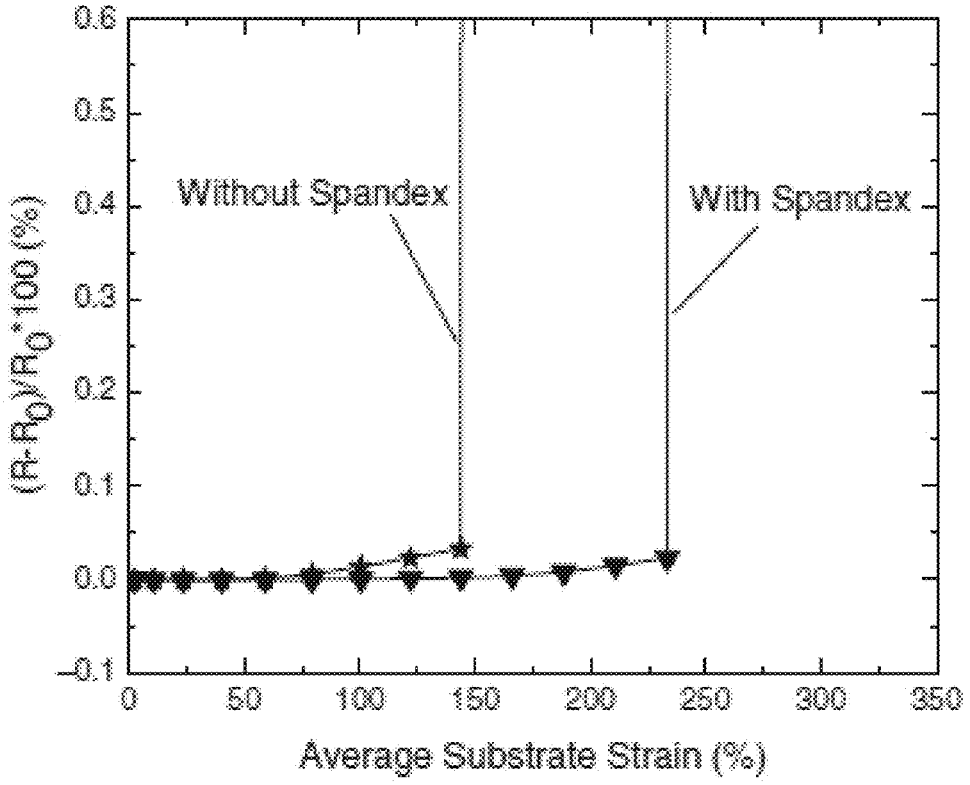
FIG. 17 is a chart representing relative change in resistance versus average strain of embodiments of the present invention that are tested.

Elastic Spandex filaments are capable of improving the elastic property of the interlaced electrical interconnects. As shown in FIG. 17, the sample with underfed Spandex filament can be stretched 100% strain more than that without Spandex filament in the three-dimensional punch test. Different interlaced electrical interconnects are able to be fabricated by adding Spandex filaments of 40 and 70 denier, respectively. The initial resistance of interconnects with 25 cm and fatigue time at 78% strain are summarised in Table 3 below. The initial resistance is not influenced by the amount of the Spandex filament, whereas the life cycles increase by 20% with 70 denier Spandex filament. The copper wire is covered by a larger amount of Spandex filaments, avoiding mechanical compression and friction with the ball. Therefore, resistance to fatigue is improved with the larger amount of Spandex filaments used.

TABLE 3

Resistance and life time with different amount of spandex filaments

| Samples | Resistance (ohm) | Mean life time (cycles) |
|---|---|---|
| With 40 denier spandex | 24.9 | 308 |
| With 70 denier spandex | 25.3 | 370 |

From the experimental results in the previous sections, it is apparent that the effect of local mechanical compression and friction on fatigue resistance overrides those due to bending and torsional strain of the copper wires in the punch test. To further confirm this observation, another experiment is performed in which identical materials and fabric structures are used for two electrical interconnects but with the tightness of the fabrics being varied by changing the gauge (number of needles per unit length) of the knitting machine. Hence the fabric substrate with a large gauge number will have more loops per unit length—that is, the deformational strain due to bending and torsion of the copper wires is larger in a more closely packed fabric. We used 30 μm copper wires and co-knitted the elastic interconnects with a gauge 22 and a gauge 25 knitting machine. As shown in Table 4 below, the samples made by the 25-gauge machine have, as expected, the higher initial resistance due to the increase of the copper length. The life cycles at 78% strain are not influenced by the variation of the deformational strain of the copper wire in the knit loops, that is, by variation in the gauge of the knitting machine.

TABLE 4

Resistance and life time with different gauge of knitting machine

| Samples | Resistance (ohm) | Mean life time (cycles) |
|---|---|---|
| With gauge 22 | 20.5 | 312 |
| With gauge 25 | 24.9 | 308 |

In addition to demonstrating stretchability and durability, embodiments of the present invention also demonstrate washability. 22 sample embodiments each containing copper wires in the course direction are automatically machine washed for 30 cycles with reference to the standard AATCC135. It is observed that 18 samples are able to be washed more than 30 cycles with constant resistance whilst 4 samples fail the test after at least 3 washing cycles are completed. The results suggest that the interlaced electrical interconnect can be washed for wearable applications. The failed samples could be prevented in future by protecting the conductive wires with chemical or mechanical insulation before knitting the conductor into the knitted fabrics.

In summary, embodiments of the present invention provide an interlaced stretchable electrical interconnect suitably flexible and stretchable for repeatedly conforming to three-dimensional curvilinear bodies. A super fine enameled metal wire is integrated into an elastic knitted fabric substrate. The electrical interconnect exhibits satisfactory conductivity, large stretchability and durability. It reaches over 5000 life cycles in a three-dimensional punch fatigue test at an average strain of 40%. Further investigation illustrates the most dominating factor for the fatigue resistance is the mechanical compression and friction between the metal wire and the stainless steel ball in the three-dimensional punch test, and the wire diameter plays a secondary role. Such stretchable and durable performances in three-dimensional punch measurements demonstrate that the interlaced elastic interconnects are capable of warping around deformable curvilinear body shapes. One example application is a stretchable sensor matrix using interlaced interconnects for wearable electronics.

Figure 21:
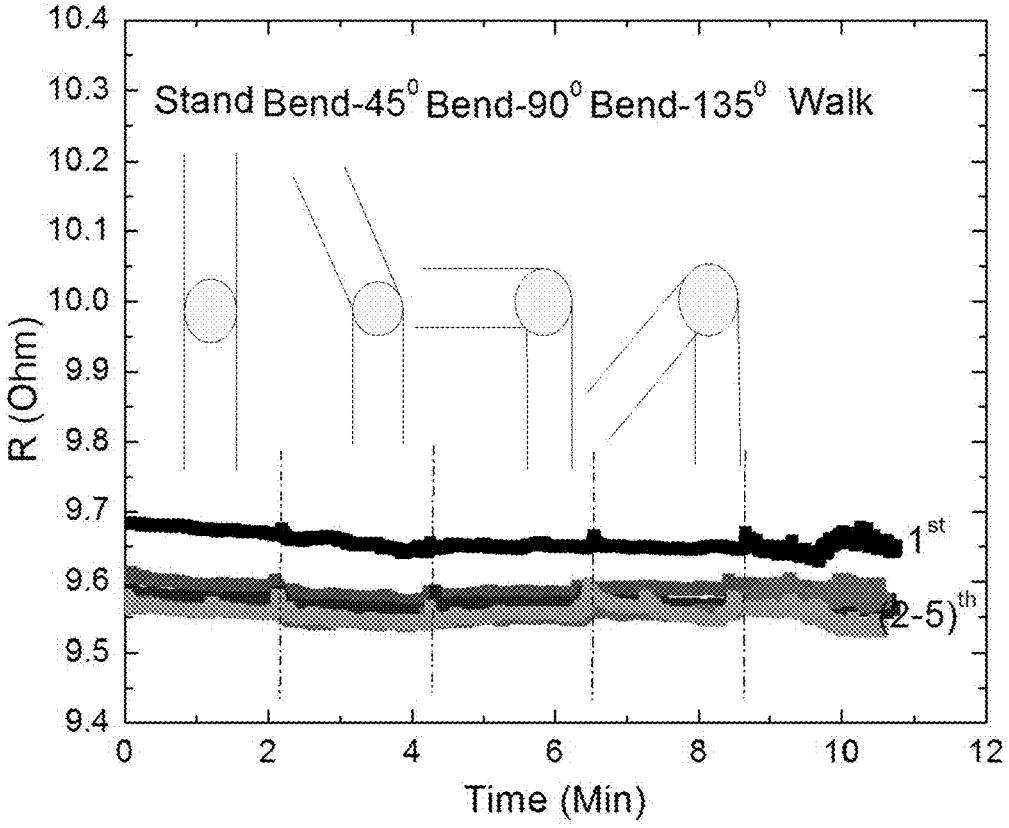
FIG. 21 shows a chart representing the variation in resistance of a stretchable electrical interconnect integrally formed in a knee-pad in accordance with an embodiment of the present invention, where the subject wearing the knee-pad is variably standing, bending, and walking during testing.

FIG. 21 represents the results of testing of a sample embodiment in the form of a kneepad incorporating a stretchable interlaced electrical interconnect in which the resistance is measured in relation to different body positions including standing, bending of the knee at different angles, and walking. It is evident that the resistance of the electrical interconnect remains substantially unchanged in response to the movement of the knee. Thus, embodiments of the present invention can be suitably worn on human bodies to monitor human activities, gestures as well as human vital signs in real time.

In a further embodiment, a coupling interface is provided for coupling an electronic component such as a sensor, an actuator and a battery with the interlaced electrical interconnect.

Figure 22:
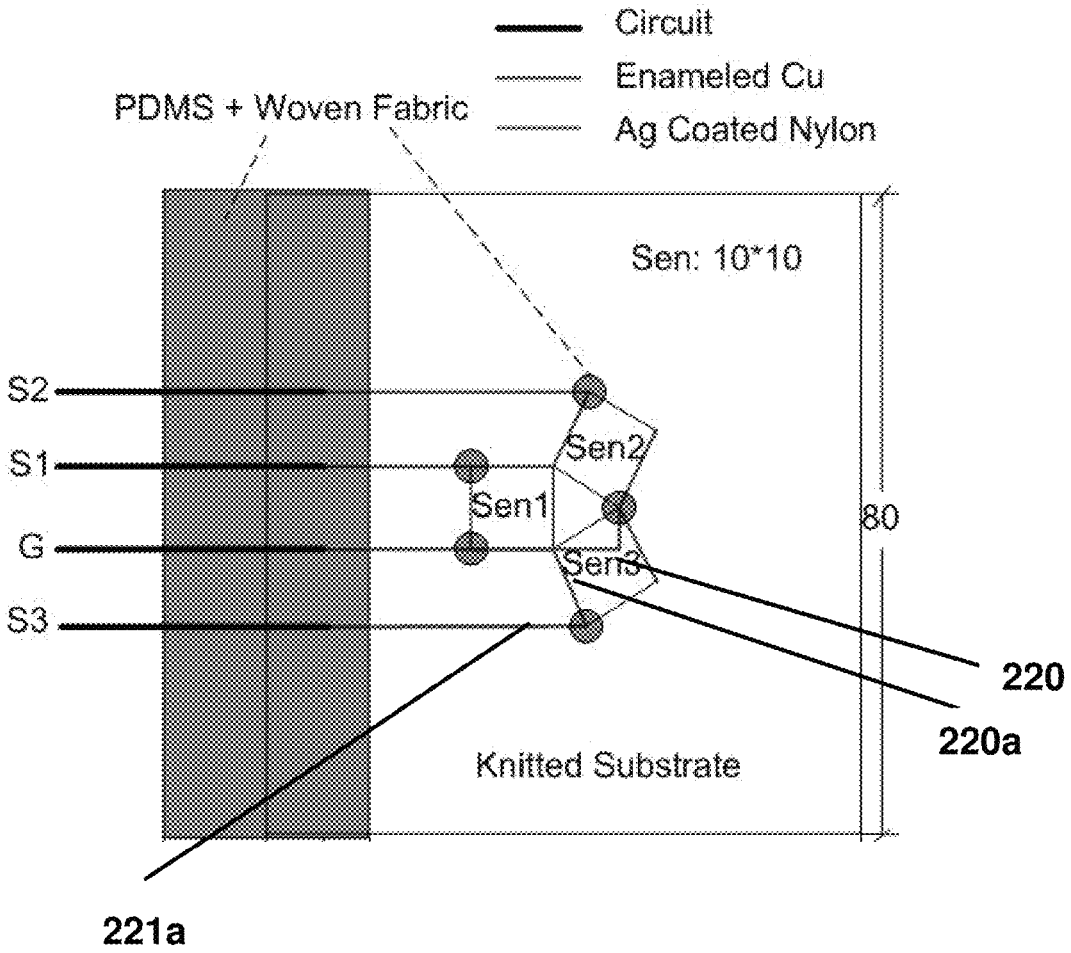
FIG. 22 represents a typical arrangement for coupling sensor electrodes to conductive fibres of an electrical interconnect.

FIG. 22 depicts a current arrangement for interfacing electrodes (220*a*) of sensor components (220) with the electrically-conductive fibres (221*a*) of an electrical interconnect (221). The electrodes (220*a*) are silver coated nylon yarn, which is brittle and fine and therefore not suitable for being soldered to the electrically conductive fibres (221*a*).

Figure 23:
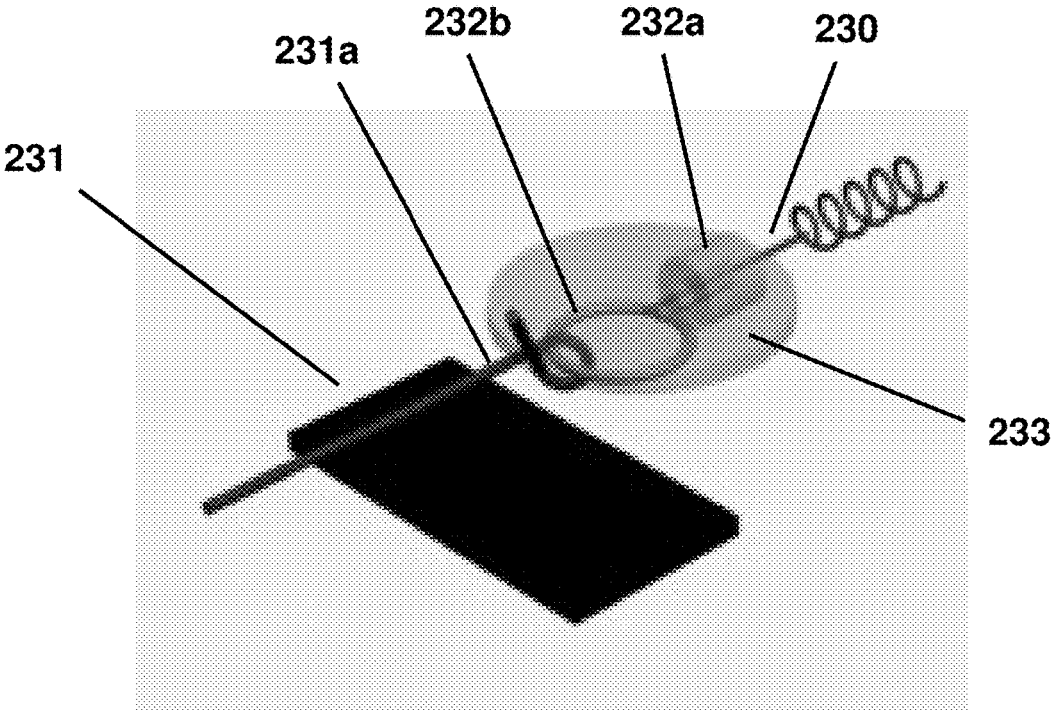
FIG. 23 shows a coupling interface in accordance with a further embodiment of the present invention where the coupling interface is configured for electrically coupling a sensor electrode to a conductive wire of an electrical interconnect.

FIG. 23 depicts the further embodiment which assists in realising an intimate and firm contact between the electrically conductive fibres (230) of the electrical interconnect and the soft electrodes (231*a*) of the sensor (231). The coupling interface comprises a first portion (232*a*) in the form of a cylindrical drum having a diameter of approximately 2 mm. A second portion (232*b*) rigidly extends from the first portion and includes a closed ring formed from a metal wire of approximately 1 mm diameter.

As shown in FIG. 23, the cylindrical drum (232*a*) of the first portion provides a relatively broad surface to which the electrically-conductive wire (230) of the electrical interconnect can be relatively easily soldered. Furthermore, the ring (232*b*) provides a relatively broad structure to which the electrode (231*a*) of the electrical component can be easily hooked, or, tied on to without requiring soldering. The wire which forms the ring (232*b*) of the coupling interface is of a relatively larger diameter to that of the electrode of the electrical component.

After the electrode (231*a*) has been knotted to the ring (232*b*) and the conductive fibre (230) has been soldered to the cylindrical portion (232*a*), an electrically conductive paste (233) is covered over the entire coupling interface including the contact points of the coupling interface with the electrode (231*a*) and with the conductive fibre (230). The paste (233) is an elastomer including at least one of copper, gold, silver and carbon particles.

In testing of this coupling interface embodiment, a three-dimensional ball punching test is conducted. A sample is fastened in the ring clamp, with the connection point in the middle part, without tension. The electrical resistance is recorded by 0.05 sec/data when the sample is punched by the stainless steel ball. The speed of the steel ball is 305 mm/min. The resistance is found to remain stable within 150% average membrane strain, which suggests that the current method is quite suitable for flex-rigid connection in stretchable electronics.

Embodiments of the present invention satisfy the requirements for wearable electronics. Thus, they can be used on human bodies to provide biomedical and human activity monitoring, gestures as well as human vital signs in real time. For instance, the stretchable electrical interconnect can be integrated into a garment that is worn on a subject, and a series of sensors can be conveniently connected together and interfaced with the electrical interconnect so as to monitor vital biomedical signs of the subject.

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

What is claimed is:

1. An electrical interconnect including at least one electrically-conductive fibre and at least one non-electrically conductive fibre knitted into a stretchable interlaced knitted configuration, the at least one electrically-conductive fibre forming interlaced loops which slide and change geometries within the interlaced configuration when stretched, such that an electrical resistance of the electrical interconnect is substantially unchanged when the electrical interconnect is repeatedly flexed or stretched about at least one three-dimensional surface.

2. An electrical interconnect as claimed in claim 1 wherein the electrically-conductive fibre includes at least one of a conductive polymer, a metal wire, an enamelled metal wire, a metal wire coated by polyurethane, and a metal-coated textile yarn.

3. An electrical interconnect as claimed in claim 1 wherein the non-electrically-conductive fibre includes at least one of polyester, nylon, Spandex filaments, and a composite thereof.

4. A garment including an electrical interconnect formed in accordance with claim 1.

5. A method of forming an electrical interconnect including knitting at least one electrically-conductive fibre and at least one non-electrically conductive fibre into a stretchable interlaced knitted configuration, the at least one electrically-conductive fibre forming interlaced loops which slide and change geometries within the interlaced configuration when stretched, wherein the interlaced configuration is configured such that an electrical resistance of the electrical interconnect is substantially unchanged when the electrical interconnect is repeatedly flexed or stretched about at least one three-dimensional surface.

6. A method as claimed in claim 5 wherein the electrically-conductive fibre includes at least one of a conductive polymer, a metal wire, an enamelled metal wire, a metal wire coated by polyurethane, and a metal-coated textile yarn.

7. A method as claimed in claim 5 wherein the non-electrically conductive fibre includes at least one of polyester, nylon, Spandex filaments, and a composite thereof.

* * * * *